US011308768B2

(12) United States Patent
Hirsch

(10) Patent No.: US 11,308,768 B2
(45) Date of Patent: Apr. 19, 2022

(54) SYSTEM FOR AN ALTERNATIVE VERSION OF POKER

(71) Applicant: Platform Gaming Technologies, Inc., Tampa, FL (US)

(72) Inventor: David Brian Hirsch, Tampa, FL (US)

(73) Assignee: Platform Gaming Technologies, Inc., Indianapolis, IN (US)

( * ) Notice: Subject to any disclaimer, the term of this patent is extended or adjusted under 35 U.S.C. 154(b) by 0 days.

(21) Appl. No.: 16/939,929

(22) Filed: Jul. 27, 2020

(65) Prior Publication Data

US 2021/0049870 A1 Feb. 18, 2021

Related U.S. Application Data

(60) Provisional application No. 62/886,453, filed on Aug. 14, 2019.

(51) Int. Cl.
*G07F 17/32* (2006.01)

(52) U.S. Cl.
CPC ..... *G07F 17/3293* (2013.01); *G07F 17/3223* (2013.01); *G07F 17/3244* (2013.01); *G07F 17/3262* (2013.01)

(58) Field of Classification Search
CPC ..... G07F 17/3293; G07F 17/3223; G07F 17/3244; G07F 17/3262
See application file for complete search history.

(56) References Cited

U.S. PATENT DOCUMENTS 5,660,393 A * 8/1997 Dreger ..... A63F 3/00157 273/274
7,785,183 B1 * 8/2010 Stockham ..... G07F 17/34 463/13
2009/0061975 A1 3/2009 Ditchev
2014/0073415 A1 3/2014 Sammon et al.
2015/0332561 A1 11/2015 Baerlocher
2016/0155291 A1 6/2016 Brown et al.

FOREIGN PATENT DOCUMENTS

WO WO-0218023 A1 * 3/2002 ..... G07F 17/3262

* cited by examiner

*Primary Examiner* — Werner G Garner
(74) *Attorney, Agent, or Firm* — Larson & Larson, P.A.; Frank Liebenow; Justin P. Miller

(57) ABSTRACT

A system and method of gaming includes randomly selecting a first set of cards from a deck and analyzing them to determine a combination that yields a highest payout amount from a payout schedule. Probabilities of achieving better combinations of the cards are determined by combining the first set of the cards with all possible combinations of a second number of the cards taken from the cards remaining in the deck. For each such probability, a present value is calculated by summing products of each probability of achieving the better combination by the amount for achieving the better combination from the payout schedule and then adding the sum to the highest payout amount. The player is given a choice to accept the present value or receive the second number of cards to complete the hand and either wins or loses based on the hand with respect to the payout schedule.

20 Claims, 13 Drawing Sheets

SYSTEM FOR AN ALTERNATIVE VERSION OF POKER

CROSS-REFERENCE TO RELATED APPLICATION

This application claims the benefit of U.S. provisional application No. 62/886,453 filed on Aug. 14, 2019, the disclosure of which is incorporated by reference.

This application is related to U.S. non-provisional utility application titled "A System for an Alternative Version of Video with Redraw," filed even date here within.

FIELD

This invention relates to the field of entertainment and more particularly to a system to administer an alternative version of video poker and other video card games and games of chance.

BACKGROUND

Video poker originated from mechanical poker, which was invented in 1891 by Sittman and Pitt. In 1898 by Charles Fey introduced the "Card Bell", was a poker machine that would pay up to 20 coins for a royal flush. Three years later, in 1901 Charles Fey created the "Skill Draw", which was the first 5-card draw poker machine. It enabled a player to hold one or more of the cards in their hand and then spin the machine again to try and improve it. Seventy years later, poker machines transitioned from a mechanical device into an electronic device employing video displays.

In 1970 Dale Electronics introduced the "Poker-Matic", the world's first video poker machine. Later, in the mid 1970's, Si Redd, a distributer for Bally's Gaming, invented a new game called "Video Poker." Within months, as interest grew, Redd began manufacturing and distributing machines with Fortune Coin Company. By 1981, Video Poker was among the most popular gaming machines in casinos. Redd's company was later taken public and renamed as International Gaming Technology (IGT). IGT is now one of the largest companies in the global casino gaming equipment industry. In the late 1990's, another variation of video poker was introduced. It was invented by Ernest Moody and called "Triple Play Poker". It enabled a player to play multiple hands of 5-card draw video poker simultaneously. Triple Play Poker was extremely successful. It was licensed by IGT and along with other games created by Moody, has been incorporated into tens of thousands of multi-game video poker machines that are played around the world.

Video poker is a single-player game that is played at a VGT (Video Gaming Terminal) or online through a browser or mobile device. Players do not compete against other players for the best relative five-card poker hand. In video poker, players play against the game operator or "house" and are awarded a payout according to a pre-published payout schedule for achieving certain five-card poker hands. For example, a player wagering $1.00 who achieves a full house will win $10.00 according to a specific payout table. In video poker, a single wager is placed before the hand is dealt and no table wagering is employed.

Many existing versions of video poker utilize a 5-card draw format. Typical 5-card draw video poker works as follows. First, the player sets the wager amount. The player then clicks on a deal button and the player is dealt five cards face-up, randomly from a virtual 52-card deck. Next, the player selects from zero to five of the five cards to "hold". Cards not selected are considered "discarded" and removed from the player's hand. After the player has selected which, if any, of the five cards to hold, the player clicks a "draw" button and each card that was discarded is randomly replaced with one of the remaining 47 cards in the deck (the "draw" cards). In single-hand video poker, draw cards are mutually exclusive. In other words, a single draw card can only be assigned once. For example, if the King of Diamonds and the seven of clubs remain in the player's hand and the six of hearts, the two of spades, and the eight of clubs have been discarded, the randomly drawn replacement cards cannot be any of the six of hearts, the two of spades, and the eight of clubs. As such, no single card will appear more than once in any hand.

Once all discarded cards have been replaced, the hand is analyzed to determine if it qualifies for a prize. If it does, then a payout is awarded from a pre-published payout schedule. Typically, a hand is only eligible to win one payout; the highest payout the highest scoring hand it qualifies for. For example, in a game of video poker where a three-of-a-kind (three cards of the same number or value) and a full house (one three-of-a-kind and a pair) both qualify for a payout, a hand that contains a full house will only be eligible for a the payout associated with a full house as it is the higher scoring hand. The hand will not be eligible to win payouts for both a full house and a three-of-a-kind.

Some versions of 5-card draw video poker incorporate a deck that includes some variant of a "wild" or "special" cards (i.e. a 54-card deck that includes two "Jokers" that serve as a wild cards or special cards). Some versions turn an existing card such as a deuce into a wild card whereby that card is used as any other card in the deck, which enables certain hand combinations to be achieved. For example, one popular version is Deuces Wild where all 2's are considered wild cards. In this game format, in a hand that includes two Aces, a six, a nine and a two (deuce), the deuce is counted as an Ace and the hand is credited as having three Aces, resulting in a bigger payout.

Still other versions of 5-card draw video poker enable a player to play multiple derivative hands simultaneously. These forms of "multi-hand" poker all essentially work the same way. As with single-hand 5-card draw video poker, the player is randomly dealt five cards from the deck. This five-card hand is considered the "lead" hand. The player then manually selects from zero to five hold cards from the lead hand, non-selected cards are discarded and multiple derivative-hands are then created, all with the same selected hold cards and number of replacement cards dealt. For example, if a player is playing 10-hands and selects an Ace of Spades, King of Spades and Queen of Hearts from the lead hand, nine derivative hands are created with the exact same hold cards and then two replacement cards. Next, just as in single-hand 5-card draw video poker; the player clicks the draw button to draw replace the replacement cards. However, in most multi-hand video poker, each derivative hand draws replacement cards from its own set draw cards, each containing the same 49 cards. As such, draw cards are not mutually exclusive and the same cards might be drawn by two different derivative hands. For example, derivative hand one might have the Ace of Spades and Derivative hand five might have it as well. However, as with single-hand draw video poker, no individual hand will have two of the same card.

Globally, the most popular form of poker is Texas Hold'em. In Texas Hold'em, subsequent cards are not drawn, but rather each player is dealt a fixed number of cards unique to them ("hole cards") which are then combined with a pre-set number of community cards (cards available to every player). Winning hands are typically determined by taking the best five-card poker hand derived from each player's hole cards combined with the community cards. For example, if a player has an Ace and a King as their hole cards and the five community cards consist of two Aces, a four, a nine and a seven, the player would have three Aces with a King and 9 as remainder cards.

Texas Hold'em is a multi-player game, typically played at a table by two to ten players. In Texas Hold'em, there are five community cards dealt face down and each player is dealt two hole cards face up. The community cards are then revealed to the players in three sequential stages. In the first stage, commonly referred to as "the flop", the first three community cards are revealed to the players. In the next stage, an additional single community card, commonly referred to as "the turn" is revealed, and then in the third stage, the final community card, commonly referred to as "the river" is revealed. Rounds of sequential table wagering take place before and after stage. During each round of betting, players make wagering decisions sequentially and have the option to check, call, raise, or fold. Betting order typically flows clockwise around the table of play for at least one rotation. However, several full rotations might occur before a given round is concluded. Normally, players have a limited time to make their betting decisions (i.e. 30 seconds or less to submit a decision or a forced fold is imposed). A single round of wagering might last a single rotation and end in a matter of seconds, or multiple rotations might occur, which can take several minutes to conclude. At the conclusion of all stages and rounds of betting, all remaining players, that is players who have not folded their hands, reveal their cards and the player with the best five-card hand combination from their hole cards and the five community cards wins the pot.

Texas Hold'em and other variations of poker were traditionally played in card rooms. However, in the mid-1990's with the arrival of the Internet, poker was taken online. The first real money hand in online poker was believed to be held on Jan. 1, 1998 by Planet Poker. Several other operators followed suit, including Paradise Poker, which quickly overtook Planet Poker and became the most popular site online. In the early 2000's several competitors entered the market, including UltimateBet, Party Poker and PokerStars, and by the mid-2000's many thousands of people were playing poker online every day. However, the explosive growth, at least in the U.S., was curtailed with the passage of the UIGEA (Unlawful Internet Gambling Enforcement Act), which made online gambling illegal in the U.S. Despite the new regulation, many operators continued to permit U.S. player on their sites. However, on Apr. 15, 2011, commonly referred to as "Black Friday", the U.S. Department of Justice secured indictments against three of the industry's biggest operators; PokerStars, Full Tilt Poker and Absolute Poker. This effectively curtailed the industry and culminated in the virtual elimination of U.S. players participating in online poker. Nevertheless, online poker continued to thrive outside the U.S. and in the early 2010's several states started to enable regulated online play, which was facilitated by an opinion letter by the Department of Justice that stated that the Wire Act, another piece of relevant legislation, was only applicable to sports wagering. However, during the last few months, the Department of Justice reversed this stance, which has led to much confusion as to the relevance of the Wire Act. At present, the matter is under litigation with a recent Federal Court decision being rendered that was averse to the D.O.J.'s stance. As such, operators in regulated states where online poker has been legalized continue to operate.

Despite the fact that online poker is still largely illegal in the U.S., poker still remains extremely popular with most of the U.S. play occurring offline in physical poker rooms. Poker is also quite popular in the rest of the world where it is physically played in numerous poker rooms and through a variety of online poker providers in both regulated and unregulated markets. Additionally, many online poker operators and casino operators have also incorporated various versions of video draw poker into their sites. However, ironically, there is no version of single-player video or online poker that exists in the marketplace today.

What is needed are new versions of video poker, that enable poker and other multi-player card games to be played in a single-player format and provides a player some measure of control or influence in game play while being fun, fast, easy-to-learn and play. All of this while providing a game structure and format that ensures game integrity, eliminates fraud by either the game operator or players, and provides an independently verifiable mathematical edge to a game operator.

SUMMARY

People are typically more likely to play and enjoy a digital or "video" version of a traditional game where the basic game is widely popular and the rules and mechanics of the game are easy to learn and understand. People are also more likely play and enjoy a video game version of a traditional game when they feel or perceive that they have some influence in the game play or outcome, even if that perception in false. Additionally, people are typically more likely to play a fast, easy-to-learn and play game that offers the ability to play multiple hands simultaneously. People also prefer games where their reward, if any, is transparent, especially when game play is fair. Lastly, game operators prefer offering games when they hold a verifiable mathematical edge in the outcome.

In one embodiment, a gaming system is disclosed including a game server and a client device that is associated with a player. The server has a software representation of a deck of cards and a payout schedule. As an example, the deck of cards is a poker-style deck of cards having four suits (clubs, diamonds, hearts, spades) and 13 card values in each suit ranging from a two to a ten, a jack, queen, king, and ace. Some such decks include one or two joker-style cards. The payout schedule includes a payout amount for achieving each of certain combinations of the cards. The server requests a first wager from the client device and the server debits the wager from an account associated with the player. After the server collects the first wager, the server randomly selects and moves a first number of the cards from the deck of cards into a first set of cards and sends the first set of the cards at the client device and the client device displays the first set of the cards. The server analyzes the first set of the cards to determine a combination of the first set of the cards that yield the highest payout amount from the payout schedule and calculates a probability of achieving a better combination of the cards by combining the first set of the cards with all possible combinations of a second number of the cards taken from cards remaining in the deck of the cards, and for each probability of achieving the better combination of the cards, the server calculate a present value of the first set of the cards by summing products of each probability of achieving the better combination of the cards by the amount for achieving the better combination of the cards from the payout schedule and adding the highest payout amount. The server sends the present value of the first set of the cards to the client device and the client device displays the present value of the first set of the cards along with an option to accept or reject the present value. If the server receives acceptance from the client device, the server credits the account associated with the player with the present value. If the server receives rejection from the client device, the server randomly selects the second number of the cards to be the second set of the cards from the cards remaining in the deck of the cards and the server analyzes the first set of the cards combined with the second set of the cards to determine the combination of the first set of the cards with the second set of the cards that yields the highest payout amount from the payout schedule. The server then credits the account associated with the player with the highest payout amount and the server sends the second set of the cards, the combination of the first set of the cards with the second set of the cards that yield the highest payout amount, and the highest payout amount to the client device; and the client device displays the second set of the cards, the combination of the first set of the cards with the second set of the cards that yield the highest payout amount and the highest payout amount.

In another embodiment, a method of gaming by a player is disclosed including requesting a first wager from the player and debiting the wager from an account of the player. A first number of cards is randomly selected from a software representation of a deck of cards, moved into a first set of the cards and displayed for viewing by the player. The first set of cards are analyzed to determine a combination that yields a highest payout amount from a payout schedule and a probability of achieving a better combination of the cards by combining the first set of the cards with all possible combinations of a second number of the cards taken from the cards remaining in the deck of the cards is calculated. For each probability of achieving the better combination of the cards, a present value is calculated by summing products of each probability of achieving the better combination of the cards by the amount for achieving the better combination of the cards from the payout schedule and adding the highest payout amount. The present value of the first set of the cards is displayed along with an option to accept or reject the present value for viewing by the player. Upon receiving acceptance, the account of the player is credited with the present value or upon receiving rejection, the second number of the cards is randomly selected to be the second set of cards and the first set of the cards combined with the second set of the cards is analyzed to determine the combination of the first set of the cards with the second set of the cards that yields the highest payout amount from the payout schedule and the account of the player is credited with the highest payout amount which is displayed along with the second set of cards and the combination of the first set of cards with the second set of cards that yield the highest payout amount.

In another embodiment, program instructions are tangibly embodied in a non-transitory storage medium. At least one instruction is configured to implement a system for gaming by a player wherein the at least one instruction includes computer readable instructions executed by a processor causing the system for gaming to request a first wager from a player and computer readable instructions executed by the processor further causing the system for gaming to debit the wager from an account of the player. Computer readable instructions executed by the processor further cause the system for gaming randomly select a first number of cards from a software representation of a deck of cards and to move the first number of the cards into a first set of the cards. The instructions executed by the processor further cause the system for gaming to display the first set of the cards for viewing by the player. The instructions executed by the processor further cause the system for gaming to analyze the first set of cards and determine a combination of the first set of the cards that yields a highest payout amount from a payout schedule, the payout schedule including a payout amount for achieving each of certain combinations of the cards. The instructions executed by the processor further cause the system for gaming to calculate a probability of achieving a better combination of the cards by combining the first set of the cards with all possible combinations of a second number of the cards taken from the cards remaining in the deck of the cards, and for each probability of achieving the better combination of the cards, to calculate a present value of the first set of the cards by summing products of each probability of achieving the better combination of the cards by the amount for achieving the better combination of the cards from the payout schedule and adding the highest payout amount. Computer readable instructions executed by the processor further cause the system for gaming to display the present value of the first set of the cards and an option to accept or reject the present value for viewing by the player. If acceptance is received, the instructions executed by the processor further cause the system for gaming to credit the account of the player with the present value and if rejection is received, the instructions executed by the processor further cause the system for gaming randomly selects the second number of the cards to be the second set of cards from the cards remaining in the deck of the cards and analyzes the first set of the cards combined with the second set of the cards to determine the combination of the first set of the cards with the second set of the cards that yields the highest payout amount from the payout schedule and the instructions executed by the processor further cause the system for gaming to credit the account of the player with the highest payout amount; to display the second set of cards, the combination of the first set of cards with the second set of cards that yield the highest payout amount, and the highest payout amount for viewing by the player.

In some embodiments, at least one instruction is configured to implement a single-player system for gaming in which at least one instruction includes computer readable instructions executed by a processor causing the system to represent a payout table in the user interface that provides the player with a pre-published payout schedule such as a payout for a royal flush, a straight flush, four of a kind and so on and so forth. The computer readable instructions next cause the system to request the number of hands to be played, the amount to be wagered per hand and the initiation of game play from the player. Next, the system for gaming randomly selects and removes a set of community cards, typically between one and five, from a programmed 52-card deck of cards (or deck with a greater number if special cards are utilized) and displays them face down in the user interface. Then, the system randomly selects, typically between one and five cards from the remaining cards in the deck and assigns them to each of the player's hand where they are considered that hand's "hole" cards and displayed face down. The remaining cards in the deck are not mutually exclusive to any single hand and each hand is randomly assigned the requisite number of cards from the entire set of remaining cards. For example, in a 7-card, Texas Hold'em version where there are five community cards, each hand will be randomly assigned two of the remaining 47 cards. As such, some hands may hold the same card or set of cards as another hand's hole cards, however, all hands will share the same community cards. The system for gaming then reveals one, all or a sub-set of the community cards and/or one, all or a sub-set of the hole cards of each of the player's hands by turning them face up, such that one sub-set of all of each hand's cards remains face down. The computer readable instructions then cause the system to determine the present value of each of the player's hand, which is based on that hand's revealed community and hole cards (the "Available Cards"). To do this, the system for gaming analyzes the Available Cards to determine the probability that one or more of the winning hands listed in the pre-published payout table has been or will be achieved. This is accomplished first by screening the Available Cards for combinations that have resulted in a winning hand ("Achieved Payouts"). Once the Achieved Payouts have been determined, the system for gaming then selects the highest Achieved Payout, which is set as the "Secured Payout". Next, the system for gaming screens for root card combinations ("root combinations") present in the Available Cards that have the possibility of achieving a higher winning hand than the hand associated with the Secured Payout. This is accomplished through a variety of methods, including linear programming and mathematical screening using various algorithms. Once all root combinations are uncovered, the system for gaming then accesses a probability table that provides the probability that a given root combination will achieve one or more of the winning hands listed in the payout table. If a Secured Payout has been achieved, then only those potential winning hands that produce a payout greater than the Secured Payout will be analyzed. Probabilities in the probability table are derived from standard finite mathematics and probability formulas.

Once the probabilities have been correlated for all uncovered root combinations, the system for gaming then calculates the maximum probability that the Available Cards will achieve each winning hand that would produce a payout greater than the Secured Payout. Additionally, once the maximum probability of a winning hand has been ascertained, certain adjustments are typically made to account for duplication (i.e. odds of achieving a straight flush or royal flush are subtracted from the odds of achieving a straight and a flush since a straight or flush contains the combinations for a straight flush or royal flush).

The system for gaming then determines the present value of each potential applicable winning hand by first taking that hand's potential published payout, subtracting the Secured Payout and then multiplying that amount by the maximum probability derived from the root combinations that could lead to the winning hand. The present values for all applicable winning hands are added together and then the Secured Payout is added to the total to reveal the present value of the hand's Available Cards.

Next the hand's Cash Out Offer is calculated. This is done by taking the present value of the hand's Available Cards and multiplying it by 1 minus a discount to be applied by the operator, if any. The result is the hand's Cash Out Offer or Surrender Offer. For example, if the present value of a player's hand is $10.00 and operator charges a 10% discount for a Cash Out, the Cash Out Offer would be 90% of the present value of the Available Cards, or $9.00. The system for gaming then displays the hand's Cash Out Offer through the user interface. The player has the option to click a Cash Out button and accept the Cash Out Offer, or forgo the Cash Out Offer and click the Reveal button, play out the hand and be shown the remaining face down cards. If the player clicks the Cash Out button for all of the hands they are playing, they are awarded the cumulative cash out amount from all of the hands and the game ends. If the player does not cash out of all of their hands and then clicks the Reveal button, the remaining face down cards are revealed. The cards available to all remaining player hands, which now include each hand's hole cards and all of the community cards, are then analyzed. If a player's hand qualifies for a winning payout, the player's account is credited. After all winning hands have been credited, the game ends. Once the game ends, the player clicks the Deal button to start again.

Note that it is expected that the payout table contain a discount that provides the operator an advantage over the player. For example, by taking the probability of every winning hand and multiplying it by the payouts, the payback to the player, commonly referred to as the "Return to Player or RTP", is calculated. For example, a 97% payback means that the operator receives approximately 3% of all bets each time the game is played and the player receives an average payback of 97%. In this, the payout table has a built-in advantage for the operator (or house). Having this advantage is typical with prior games of a similar nature. Therefore, in some embodiments, the operator does not discount the surrender value any further, so the player does not have an advantage or disadvantage by cashing out or surrendering their hand(s) and the operator makes their income from the payback percentage built into the payout table. In other embodiments, it is envisioned that the payback percentage is very low (e.g. 1% or lower), but the operator discounts the surrender value to achieve additional advantage if the player surrenders their hand(s). In some embodiments, the operator fine-tunes the percentages to maximize fun to the players while achieving an expected rate-or-return from each play of the game.

Other versions of this embodiment include the analysis and display of the Cash Out value of the player's hand's Available Cards at multiple times, including, before the first sub-set of community cards (or sub-set of unrevealed hole cards) are revealed, after the first sub-set of community cards (or sub-set of unrevealed hole cards) is revealed and again after each subsequent sub-set of unrevealed community cards (or hole cards) is revealed with the exception of the final sub-set. After each Cash Out offer is presented, the player has the option to click the Cash Out button and accept the Cash Out Offer, or click the Reveal button, forgo the Cash Out Offer and be shown the next sub-set of community cards (or hole cards). After the final sub-set of community cards (or unrevealed hole cards) is revealed, the cards available to the player's hand, their hole cards and all community cards, are then analyzed. If they qualify for a winning payout, the player's account is credited and the game ends. Once the game ends, the player can click the Deal button to start again.

Versions of this embodiment can be combined with one or more other versions to provide a unique gaming experience. Additionally, it is contemplated that the concepts described in all versions of this embodiment could be applied to other card games and games of chance, including blackjack, spades, etc. More specifically, in blackjack, after the player receives their two initial cards face up and the dealer has receives its two initial cards, one face up and one face down, the present value of the player's hand would be calculated using the same or similar statistical methodologies based on the player's two initial cards and the single dealer card dealt face up. The player would then be offered a cash out offer, which is accepted or declined and play continues to a final outcome.

In another embodiment, a single-player video version of poker is disclosed that includes a server and a plurality of player client devices. Each player client device is associated with a single player. A software representation of a payout table is represented in the user interface that provides the player with a pre-published payout schedule for achieving certain poker hand combinations, typically based on five cards, such as a royal flush, a straight flush, four of a kind and so on and so forth, where only the highest winning card combination from a given hand is eligible for a payout. The server first requests a wager from a given player. The player then selects the number of hands to be played and the amount to be wagered per hand and then clicks a deal button to initiate game play.

There is a software representation of a 52-card deck of cards (or any number of cards depending upon the game being played and whether special cards such as jokers are utilized) and the server randomly selects and removes a set of community cards, typically between one and five, from the deck of cards and displays them face down in the user interface. Next, the server selects the hole cards for each hand the player is playing. However, the remaining cards in the deck are not mutually exclusive to any single hand and each hand is randomly assigned the requisite number of cards from the entire set of remaining cards. For example, in a 7-card Texas Hold'em version where there are five community cards, each hand will be randomly assigned two of the remaining 47 cards. As such, some hands may hold the same card or set of cards as hole cards. However, all hands will share the same community cards. Next, the server reveals a sub-set of the community cards and/or a sub-set of the hole cards from each hand to the player by turning them face up.

The server then determines the present value of each hand, which is based on the hand's revealed hole cards and the revealed community cards (the "Available Cards"). To do this, the server analyzes the Available Cards to determine the probability that one or more of the winning hands listed in the pre-published payout table has been or will be achieved. This is accomplished first by screening the Available Cards for combinations that have resulted in a winning hand ("Achieved Payouts"). Once all Achieved Payouts have been determined, the server then determines the highest Achieved Payout, which is set as the "Secured Payout".

Next, the server screens for root card combinations ("root combinations") present in the Available Cards that have the possibility of achieving a higher winning hand than the hand associated with the Secured Payout. This is accomplished through a variety of methods, including linear programming and mathematical screening using various algorithms.

Once all root combinations are uncovered, the server then accesses a probability table that provides the probability that a given root combination will achieve one or more of the winning hands listed in the payout table. If a Secured Payout has been achieved, then only those potential winning hands that produce a payout greater than the Secured Payout will be analyzed. Probabilities in the probability table are derived from standard finite mathematics and probability formulas.

Once the probabilities have been correlated for all uncovered root combinations, the server then calculates the maximum probability that the Available Cards will achieve each winning hand that would produce a payout greater than the Secured Payout. Additionally, adjustments to account for duplication (i.e. odds of achieving a straight flush or royal flush are subtracted from the odds of achieving a straight and a flush since a straight or flush contains the combinations for a straight flush or royal flush).

The server then determines the present value of each potential applicable winning hand by first taking that hand's potential published payout, subtracting the Secured Payout and then multiplying that amount by the maximum probability derived from the root combinations that could lead to the winning hand. The present values for all applicable winning hands are added together and then the Secured Payout is added to the total to reveal the present value of the player's Available Cards.

Next each hand's Cash Out Offer is calculated. This is done by taking the present value of the hand's Available Cards and multiplying it by 1 minus a discount to be applied by the operator, if any. The result is the hand's Cash Out Offer. For example, if the present value of a player's hand is $10.00 and operator charges a 10% discount for a Cash Out, the Cash Out Offer would be 90% of the present value of the Available Cards, or $9.00. The server then displays the hand's Cash Out Offer through the user interface. The player has the option to click a Cash Out button and accept the Cash Out Offer, or forgo the Cash Out Offer and click the Reveal button to be shown the remaining unrevealed cards. If the player clicks the Cash Out button for all of the hands they are playing, they are awarded the cumulative cash out amount and the game ends. If the player does not accept the cash out for all of the hands they are playing, the player clicks the Reveal button and the remaining unrevealed cards are revealed. The cards available to the each of the player's hands, which include their hole cards and all community cards, are then analyzed. If a hand qualifies for a winning payout, the player's account is credited. Once the player has been credited for all winning hands, the game ends. Once the game ends, the player can click the Deal button to start again.

Another version of this embodiment reveals all community cards when dealt and only a sub-set of the player's hand's hole cards. The process is essentially the same as with the version above. The hand's Available Cards are analyzed and screened and a Cash Out offer is derived prior to the revelation of the unrevealed hole cards.

Other versions of this embodiment include the analysis and display of the Cash Out value of the player's hand's Available Cards at multiple times, including, before the first sub-set of community cards (or sub-set of unrevealed hole cards) are revealed, after the first sub-set of community cards (or sub-set of unrevealed hole cards) is revealed and again after each subsequent sub-set of unrevealed community cards (or hole cards) is revealed with the exception of the final sub-set. After each Cash Out offer is presented, the player has the option to click the Cash Out button and accept the Cash Out Offer, or click the Reveal button, forgo the Cash Out Offer and be shown the next sub-set of community cards (or hole cards). After the final sub-set of community cards (or unrevealed hole cards) is revealed, the cards available to the player's hand, their hole cards and all community cards, are then analyzed. If they qualify for a winning payout, the player's account is credited and the game ends. Once the game ends, the player can click the Deal button to start again.

Versions of this embodiment can be combined with one or more other versions to provide a unique gaming experience. Additionally, it is contemplated that the concepts described in all versions of this embodiment could be applied to other card games and games of chance, including blackjack. More specifically, in blackjack, after the player receives their two initial cards face up and the dealer has receives its two initial cards, one face up and one face down, the present value of the player's hand would be calculated using the same or similar statistical methodologies based on the player's two initial cards and the single dealer card dealt face up. The player would then be offered a cash out offer, which is either accepted and the cash offer is awarded or declined and continue play to a final outcome.

In another embodiment, program instructions tangibly embodied in a non-transitory storage medium comprising at least one instruction configured to implement a single-player system for gaming is disclosed in which at least one instruction includes computer readable instructions executed by a processor causing the system for gaming to represent a payout table in the user interface that provides the player with a pre-published payout schedule for achieving certain poker hand combinations, typically based on five cards, such as a royal flush, a straight flush, four of a kind and so on and so forth, where only the highest winning card combination from a given hand is eligible for a payout. The system for gaming also represents available payout lines is represented that shows the number and pathway of payout lines for a matrix of cards. For example, a payout line might be a row, a column, a diagonal line or even a sequence of cards where the subsequent card is adjacent horizontally, vertically or diagonally from the prior card. Each payout line represents one hand.

The computer readable instructions executed by the processor next cause the system for gaming to requests the number of hands to be played, the amount to be wagered per hand and the initiation of game play from the player. Next, the system for gaming randomly selects and removes a set of community cards, typically between one and three, from a standard 52-card deck of cards (or deck with a greater number if special cards are utilized) and displays them face up in the user interface.

Next, the system for gaming represents a matrix and the community cards are then displayed to the side of the matrix, typically to the left or the right of each row, but also potentially above or below each column. Each set of community cards represents the beginning of one or more payout lines. The system for gaming then randomly selects a series of hole cards from the remaining cards in the deck and displays them face up in each empty slot of matrix. Cards selected are mutually exclusive. As such, no one card will be assigned to more than one slot in the matrix. For example, if there are two community cards and five hole cards, the software might generate a five by five matrix. The two community cards would be displayed adjacent to each row of the matrix and each row would represent both a hand and a payout line. Each of the 25 slots in the five by five matrix would then be randomly filled with one of the remaining 50 cards in the deck.

Next the system for gaming analyzes each hand in the matrix to determine its best poker hand combination based on the community cards and its hole cards. Using the example above, each hand would contain seven cards, the two community cards and five hole cards. If the best poker hand combination from a given hand is a winning hand, the system for gaming alerts the player through the user interface of that hand's eligible payout based on the pre-published payout schedule. Once all hands have been analyzed, a total payout is calculated and the player's account is credited. The player may then click the Deal button play the game again.

In one version of the embodiment above, after the player clicks the Deal button to initiate game play, the system for gaming randomly selects a series of cards, typically between three and five, from a standard 52-card deck of cards (or greater number if special cards are utilized), which are displayed face down in the user interface. The system for gaming then requests the player to select a sub-set of the displayed cards as the community cards for the current round of play. Once selected, they are turned face up to reveal the round's community cards. The system for gaming then represents a matrix, and the community cards are displayed accordingly. For example, the player clicks the Deal button and five cards are displayed face down. The player then clicks the second and third cards to reveal a King of hearts and a 4 of clubs, which become the community cards for that round of play.

In another version of the embodiment above, the cards randomly selected for different hands would not be mutually exclusive to that hand alone. In other words, for each hand the system for gaming would randomly draw the requisite number of hole cards from the same set of remaining cards in the deck. For example, if there are two community cards, the first hand would be assigned five of the remaining 50 cards in the deck. Likewise, the second hand would also be assigned five of the remaining 50 cards in the deck and so on and so forth. As such, some hands will hold the same card or set of cards as others. By enabling this process, the game could essentially be adjusted to offer the player the ability to play a theoretically unlimited number of hands.

All versions of this embodiment can be combined with one or more other versions to provide a unique gaming experience. Additionally, it is contemplated that the concepts described in all versions of this embodiment could be applied to other card games and games of chance.

In another embodiment, a single-player poker game is disclosed that includes a server and a plurality of player client devices. Each player client device is associated with a single player. A software representation of a payout table is represented in the user interface that provides the player with a pre-published payout schedule for achieving certain poker hand combinations, typically based on five cards, such as a royal flush, a straight flush, four of a kind and so on and so forth, where only the highest winning combination from a given hand is eligible for a payout. A software representation of available payout lines is represented that shows the number and pathway of payout lines for a matrix of cards. For example, a payout line might be a row, a column, a diagonal line or even a sequence of cards where the subsequent card is adjacent horizontally, vertically or diagonally from the prior card. Each payout line represents one hand. The server first requests a wager from a given single player and may also request the number of hands the player wishes to play, or the number of hands to be played might be pre-configured. The player then selects the amount to be wagered, and if required, the number of hands they wish to play and then clicks a deal button to place the wager and initiate game play. There is a software representation of a 52-card deck of cards (or greater number if special cards are utilized), and the server randomly selects and removes a set of community cards, typically between one and three, from the deck of cards and displays them face up in the user interface.

Next, a software representation of a matrix is displayed. The community cards are then displayed to the side of the matrix, typically to the left or the right of each row, but also potentially above or below each column. Each set of community cards represents the beginning of one or more payout lines. The server then randomly selects a series of hole cards from the remaining cards in the deck and displays them face up in each empty slot of matrix. Cards selected are mutually exclusive. As such, no one card will be assigned to more than one slot in the matrix. For example, if there are two community cards and five hole cards, the server might generate a five by five matrix. The two community cards would be displayed adjacent to each row of the matrix and each row would represent both a hand and a payout line. Each of the 25 slots in the five by five matrix would then be randomly filled with one of the remaining 50 cards in the deck.

Next the server analyzes each hand in the matrix to determine its best poker hand combination based on the community cards and its hole cards. Using the example above, each hand would contain seven cards, the two community cards and five hole cards. If the best poker hand combination from a given hand is a winning hand, the server alerts the player through the user interface of that hand's eligible payout based on the pre-published payout schedule. Once all hands have been analyzed, a total payout is calculated and the player's account is credited. The player may then click the Deal button play the game again.

In another version of the embodiment above, after the player clicks the Deal button, the server randomly selects a series of cards, typically between three and five, from a standard 52-card deck of cards (or greater number if special cards are utilized), which are displayed face down in the user interface. The server then requires the player to select a sub-set of the displayed cards as the community cards for the current round of play. This can be accomplished by clicking a corresponding button installed in the cabinet, or by clicking the touchscreen of the display, if enabled. Once selected, they are turned face up to reveal the round's community cards. A software representation of a matrix is then represented, and the community cards are displayed accordingly. For example, the player clicks the Deal button and five cards are displayed face down. The player then clicks the second and third cards to reveal a King of hearts and a 4 of clubs, which become the community cards for that round of play.

In another version of the embodiment above, the cards randomly selected for different hands would not be mutually exclusive to that hand alone. In other words, for each hand the server would randomly draw the requisite number of hole cards from the same set of remaining cards in the deck. For example, if there are two community cards, the first hand would be assigned five of the remaining 50 cards in the deck. Likewise, the second hand would also be assigned five of the remaining 50 cards in the deck and so on and so forth. As such, some hands will hold the same card or set of cards as others. By enabling this process, the game could essentially be adjusted to offer the player the ability to play a theoretically unlimited number of hands.

Versions of this embodiment can be combined with one or more other versions to provide a unique gaming experience. Additionally, it is contemplated that the concepts described in all versions of this embodiment could be applied to other card games and games of chance.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
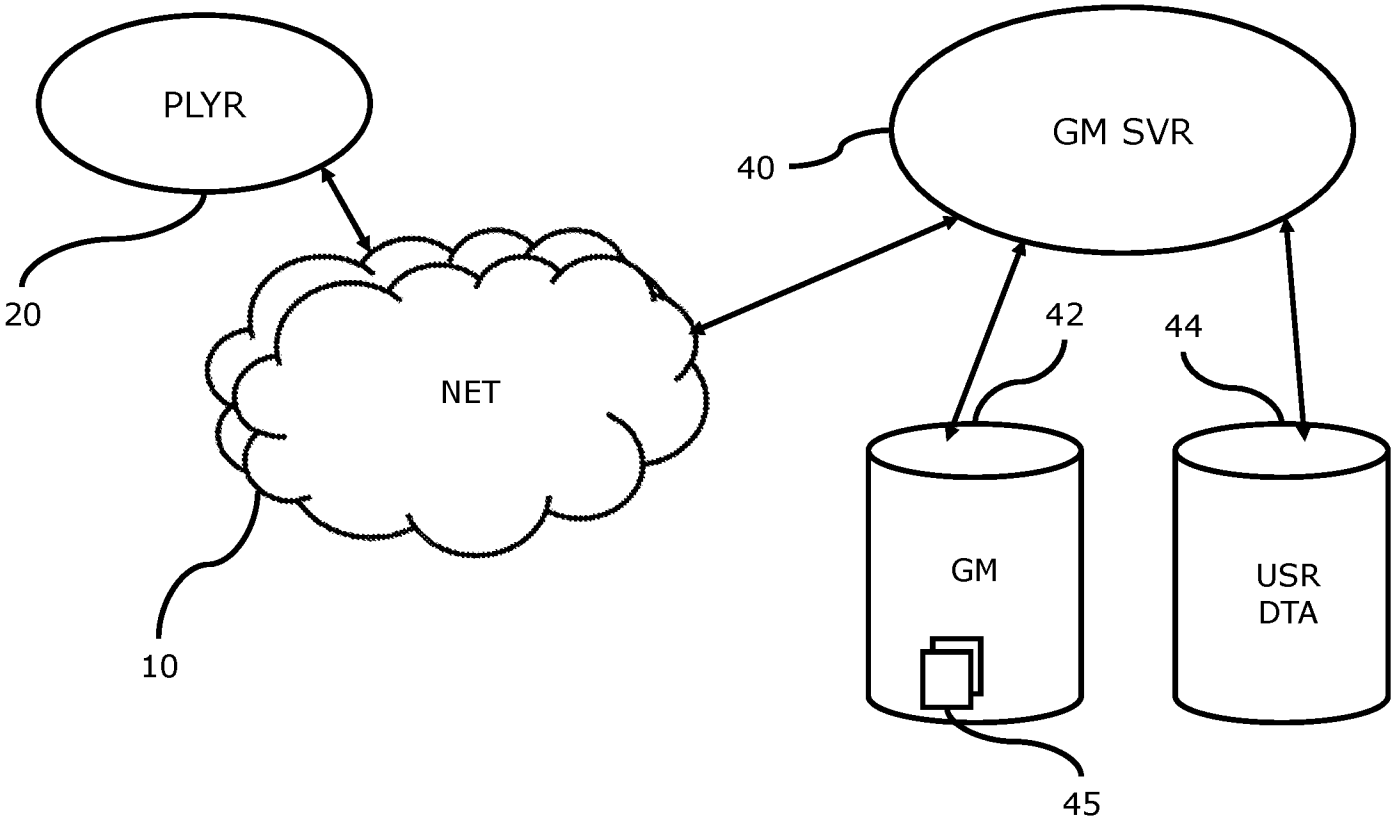
FIG. 1 illustrates schematic view of a skill gaming system.

Reference will now be made in detail to the presently preferred embodiments of the invention, examples of which are illustrated in the accompanying drawings. Throughout the following detailed description, the same reference numerals refer to the same elements in all figures.

Throughout this description, an example is made using a gaming system that is similar to the well-known game of poker. It is fully anticipated to implement the same or similar gaming system using solitaire, trivia, board games, etc., having multiple rounds of betting in which each player has an initial asset (e.g. hand) and has a choice to make during the current round, before executing the next round (e.g. the player has the option to surrender their hand for a certain reward before progressing to the next round in which their hand has the possibility of improving and achieving an even higher reward than the surrender offer).

Throughout this description the term player refers to a person who is enjoying the operation of the described system and the operator is a person or entity that provides the described system for the purpose of earning income, either directly from the player in terms of percentages of money bets made by the player or through advertisements that are presented while the player uses the system, or other marketing opportunities.

Referring to FIG. 1, a schematic view of a gaming system is shown. One or more client devices 20 (computers, smart phones, etc.) connect to the game server 40 through a network 10, for example, through the Internet. It is assumed that a user of each client device 20 is a player of the game system.

Game details and settings are stored in a game storage area 42 that is accessible by the game server 40, such as, a software representation of the deck of cards 45 (herein to be known as the deck of cards), community cards, each player's hands, number of hands, total amount wagered, etc. The user data 44 includes player data that is accessible by the game server 40 including data such as login credentials, preferences, available funds (user account), name, picture, etc. The deck of cards 45 is a data representation for the cards used by the game being played by the disclosed system. For example, the deck of cards 45 is an array of values from 1-52, each value representing one card (e.g. the value of 0X01 represents the deuce of clubs). It is anticipated that the deck be shuffled before play begins, for example, randomly moving the card values in this array to a different position in the array, or any other shuffling mechanism.

Figure 2:
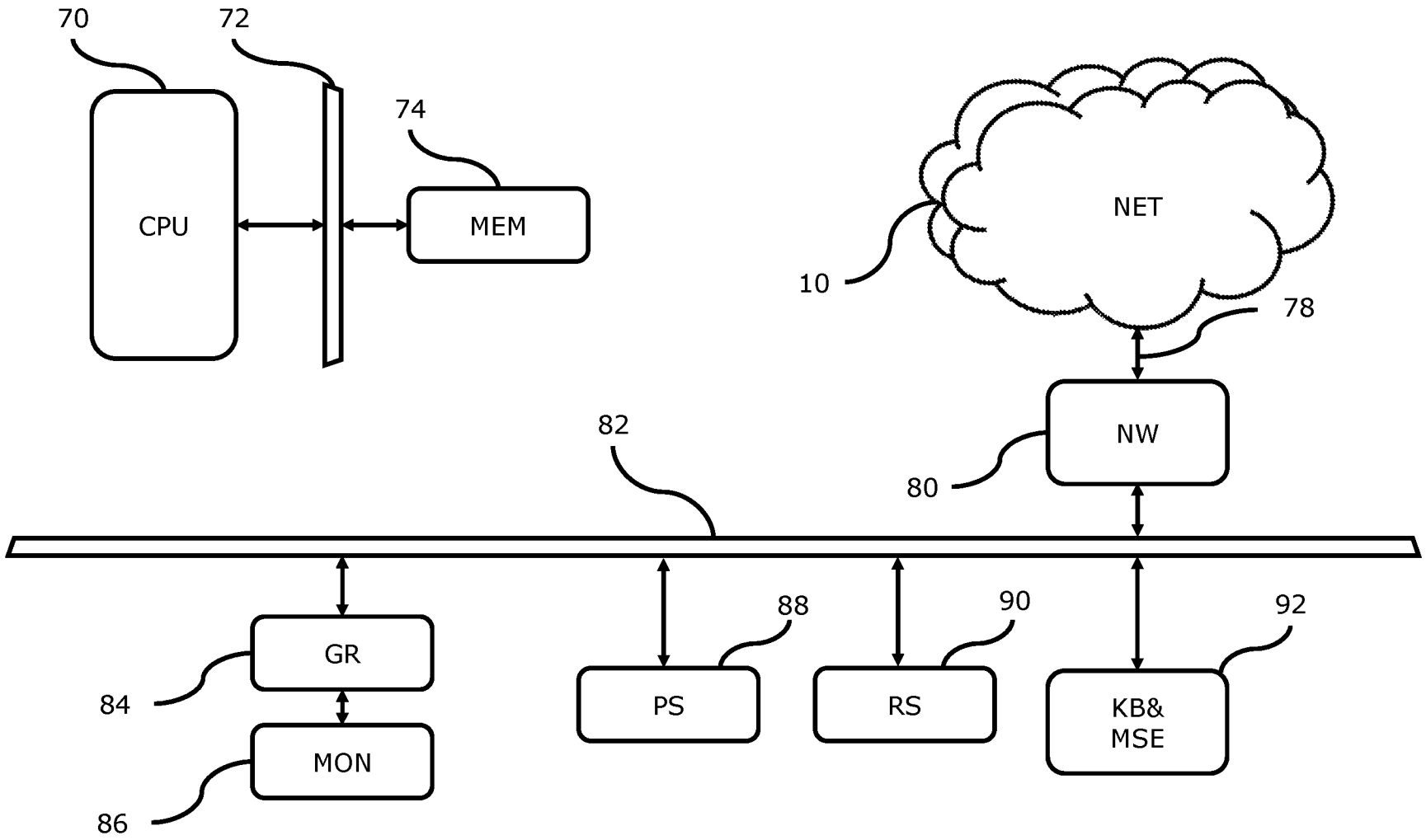
FIG. 2 illustrates a typical computer system.

Referring to FIG. 2, a schematic view of a typical computer system operating as the game server 40 or client devices 20 is shown. The example computer system represents a typical computer system used as the game server 40 and/or the client devices 20. The example computer system is shown in its simplest form, having a single processor. Many different computer architectures are known that accomplish similar results in a similar fashion and the present invention is not limited in any way to any particular computer system. The present invention works well utilizing a single processor system, as shown in FIG. 2, a multiple processor system where multiple processors share resources such as memory and storage, a multiple server system where several independent servers operate in parallel (perhaps having shared access to the data), or any combination, etc. In such systems, a processor 70 executes or runs stored programs that are generally stored for execution within a memory 74. The processor 70 is any processor or a group of processors. The memory 74 is connected to the processor, for example, by a memory bus 72 and is any memory 74 suitable for connection with the selected processor 70, such as SRAM, DRAM, SDRAM, RDRAM, DDR, DDR-2, etc. Also interfaced to the processor 70 is a system bus 82, for example, interfacing peripheral subsystems such as a network interface 80, persistent storage 88 (e.g. a hard disk), removable storage 90 (e.g. DVD, CD, flash drive), a graphics adapter 84 and a keyboard/mouse 92, etc., to the processor 70. The graphics adapter 84 receives commands and display information from the system bus 82 and generates a display image that is displayed on the display 86.

In general, the persistent storage 88 is used to store programs, executable code and player data such as player financial data in a persistent manner. The removable storage 90 is used to load/store programs, executable code, images and data onto the persistent storage 88.

These peripherals are examples of persistent storage 88 and other examples of persistent storage devices 88 include core memory, flash memory, etc. Other examples of removable media storage 90 include CDRW, DVD, DVD writeable, Blu-ray, SD cards, other removable flash media, floppy disk, etc. In some embodiments, other devices are connected to the system through the system bus 82 or with other input-output connections/arrangements as known in the industry. Examples of these devices include printers; graphics tablets; joysticks; and communications adapters such as modems and Ethernet adapters.

The network interface 80 connects the computer-based system to the network 10 through a link 78 which is, preferably, a high speed link such as a cable broadband connection, a Digital Subscriber Loop (DSL) broadband connection, fiber optics, etc.

The game server 40 maintains a representation of a deck of cards 45 (e.g. a set of cards from a standard poker deck, represented electronically) and during a game. In one game, the software running on the game server 40 randomly selects the community cards 120 from the deck of cards 45 (see FIG. 3), eliminating the community cards 120 from the deck of cards 45. Then, the software running on the game server 40 randomly selects each hole cards 122 for each player from the remaining cards in the deck of cards 45. As the game progresses, the game server 40 presents user interfaces as described later showing the community cards 120, collects bets from the client devices 20, presents surrender options, etc. As each round of the game is made, the software running on the game server 40 delivers one or more of the hole cards 122 to the client devices 20 for display to the player for making decisions as to whether to proceed to the next phase (possibly requiring additional payments), accepting a surrender value for their hand(s), etc.

Figure 3:
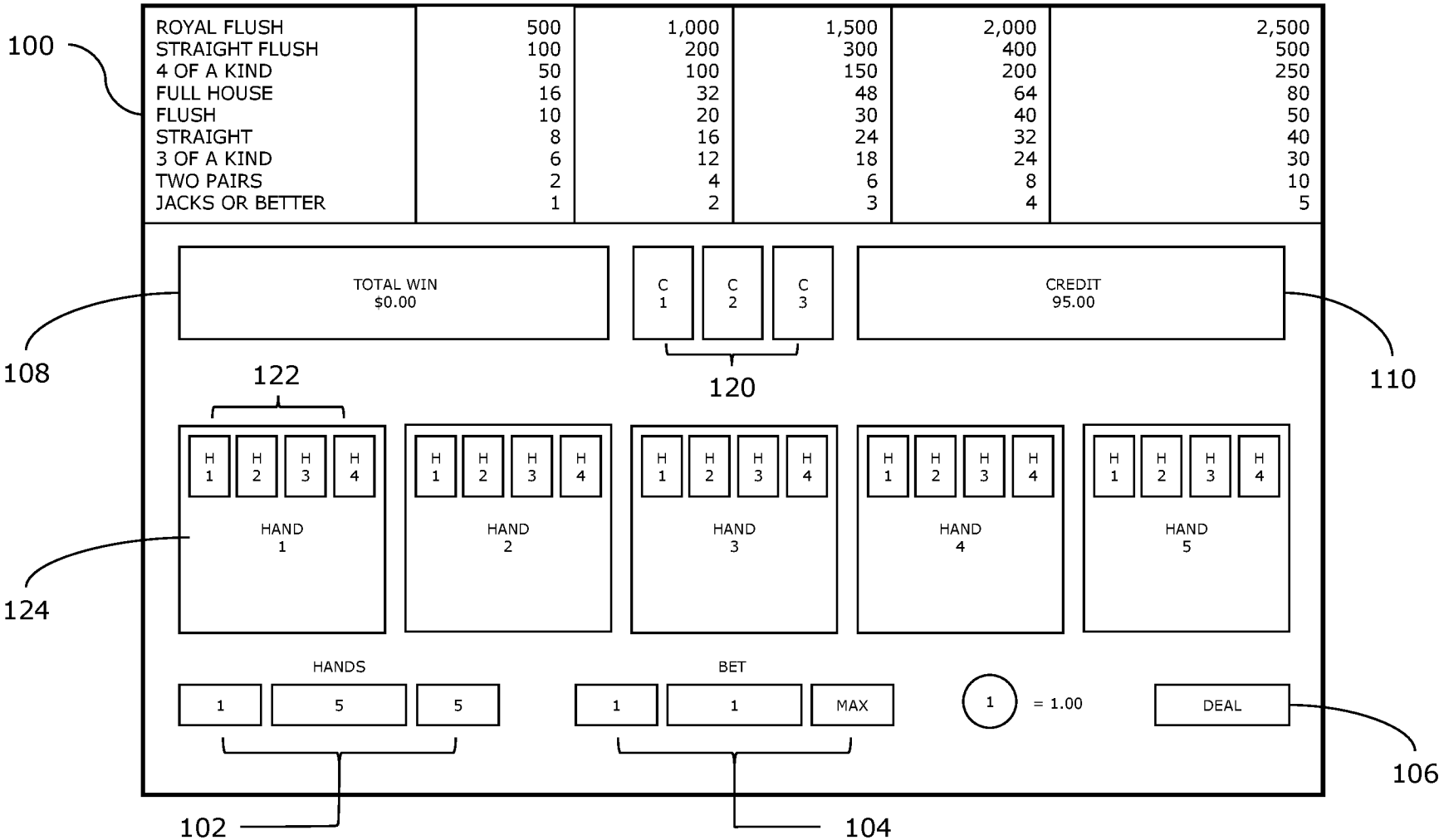
FIG. 3 is a typical initial user-interface for the game format where a player has elected to play five hands simultaneously and three cards are designated as hole cards and each hand being played will be randomly dealt four of the remaining 49 cards as Hole Cards.

FIG. 3 represents a typical initial user-interface for the game format where there are three community cards 120 and two of each hand's 124 hole cards 122 that will be displayed face up and considered each hand's available cards. In this example, there are five hands 124 being played.

A payout schedule 100 for achieving certain combinations of cards, in this example, for achieving certain combinations of cards in a 5-card poker hands is displayed. The player selects the number of hands to play using a number-of-hand selector 102 and the player selects an amount to wager per hand by a wager selector 104 (e.g. an amount of credits wagered per hand). Once the number of hands and the wager amount have been selected by the player, the deal button 106 is depressed to initiate game play.

Note that the payout schedule 100 shown in FIG. 3 and other figures is a sample and, depending upon the return desired by the operator, the payouts are adjusted up or down as appropriate. For example, the payout for a royal flush is 500 for a single bet and 2500 for a bet of 5, but some operators might choose to increase the payout for a royal flush for a bet of 5 to a higher amount, say 5000, to encourage the player to make the maximum bet. Further, in some embodiments, more than five cards are considered in the payout schedule 100. For example, there is a very slight possibility that one would achieve a seven-card royal flush (A, K, Q, J, 10, 9, 8 of the same suit) and the payout for such a low-probability hand be set to a very high value such a 1,000,000 or more.

The user-interface also includes a win notification box 108 and a credits box 110.

For each hand being played, there is a hand 124 in a display area that includes the hole cards 122 of the player.

In this example, the player, who started with 100.00 credits, has elected to play five hands, each with a wager of 1 credit. The player operates the deal button 106 and the game is initiated. The credits box 110 then displays 95.00 to reflect the 5.00 credits wagered (one for each hand).

Figure 4:
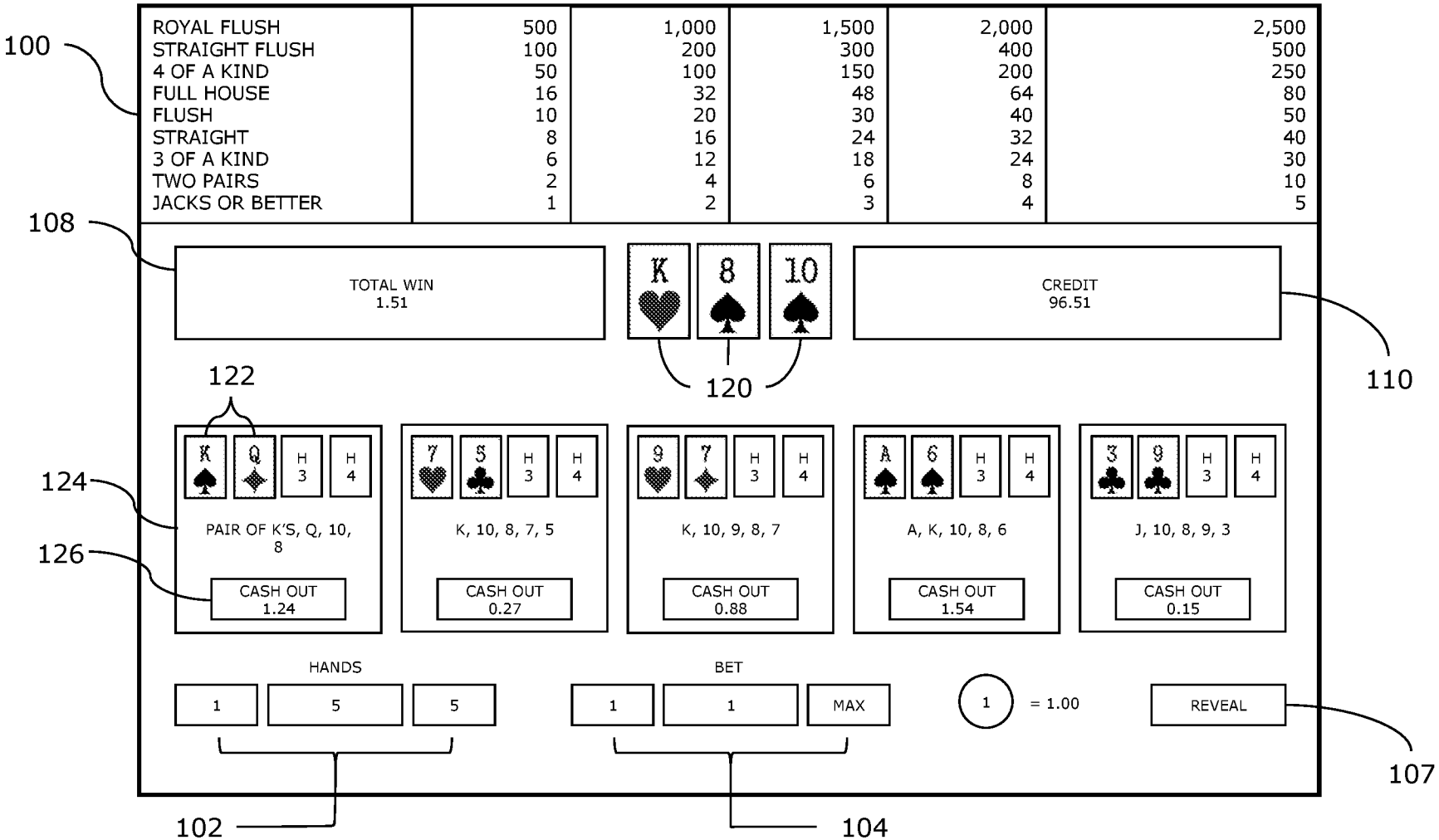
FIG. 4 illustrates the user interface in FIG. 3 after the game has started and the three community cards have been dealt face up and in each of the player's five hands, two of its four hole cards have been revealed and each hand has received a cash out offer based on its five available cards and the player has accepted the cash out offer for their first two hands, but elects to not take them for their other three hands and then clicks the reveal button to be shown the remaining two hole cards in each of the hands.

FIG. 4 represents the typical user interface above, after the game has started. The community cards 120 and two of each hand's 124 hole cards 122 are shown face up in their designated areas. Each hand's message area now displays the hands best 5-card combination and a cash out offer button 126 showing the cash out offer amount for the hole cards 122 that are face up in combination with the community cards 120.

In this example, it is shown that the player operates the cash out offer button 126 for the first two hands. Responsive to this, the win notification box 108 shows 1.51 as the sum of the cash out offers is 1.51. In addition, the credits box 110 is updated 96.51 to reflect the current credits plus the win of 1.51 from the cash out offers. The player then operates the reveal button 107 to reveal the remaining cards for each hand. Not that since the player previously accepted the cash out offer for the first two hands, those hands will not be awarded further credit, even if a better hand of the payout table is achieved as those hands have been surrendered.

Figure 5:
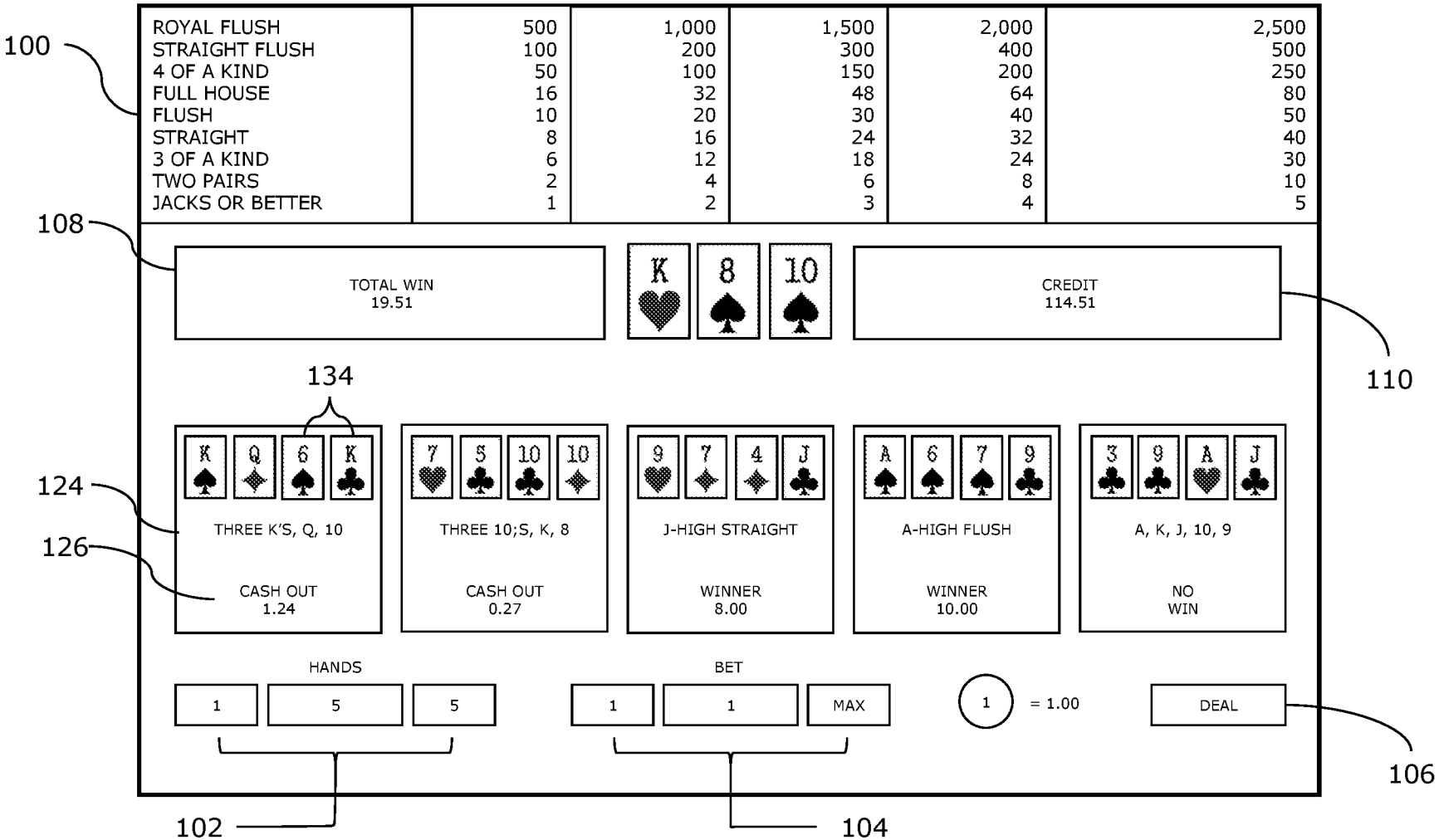
FIG. 5 illustrates the user interface in FIG. 4 after the player has depressed the reveal button and remaining cards are revealed.

Referring to FIG. 5, the user interface from above is shown after the two remaining hole cards 134 for each hand have been revealed. The message area of each hand 124 is updated to display the best 5-card combination of each hand 124 including the four hole cards 122 combined the three community cards 120, seven available cards. Note that in some embodiments, the display area of the hand 124 is updated for hands that have been surrendered, even though they are not eligible for additional payout. Each message area now includes either the cash out offer amount that was accepted of the amount the hand is awarded according to the payout schedule. Since one of the hands produced a straight and another of the hands produced a flush, winnings of 8.00 and 10.00 are added to the player's credits and shown in credits box 110 (now 114.51). The win notification box 108 shows 19.51 which is the sum of the cash out offers that were accepted (1.51) plus the two winning hands (18.00).

Figure 6:
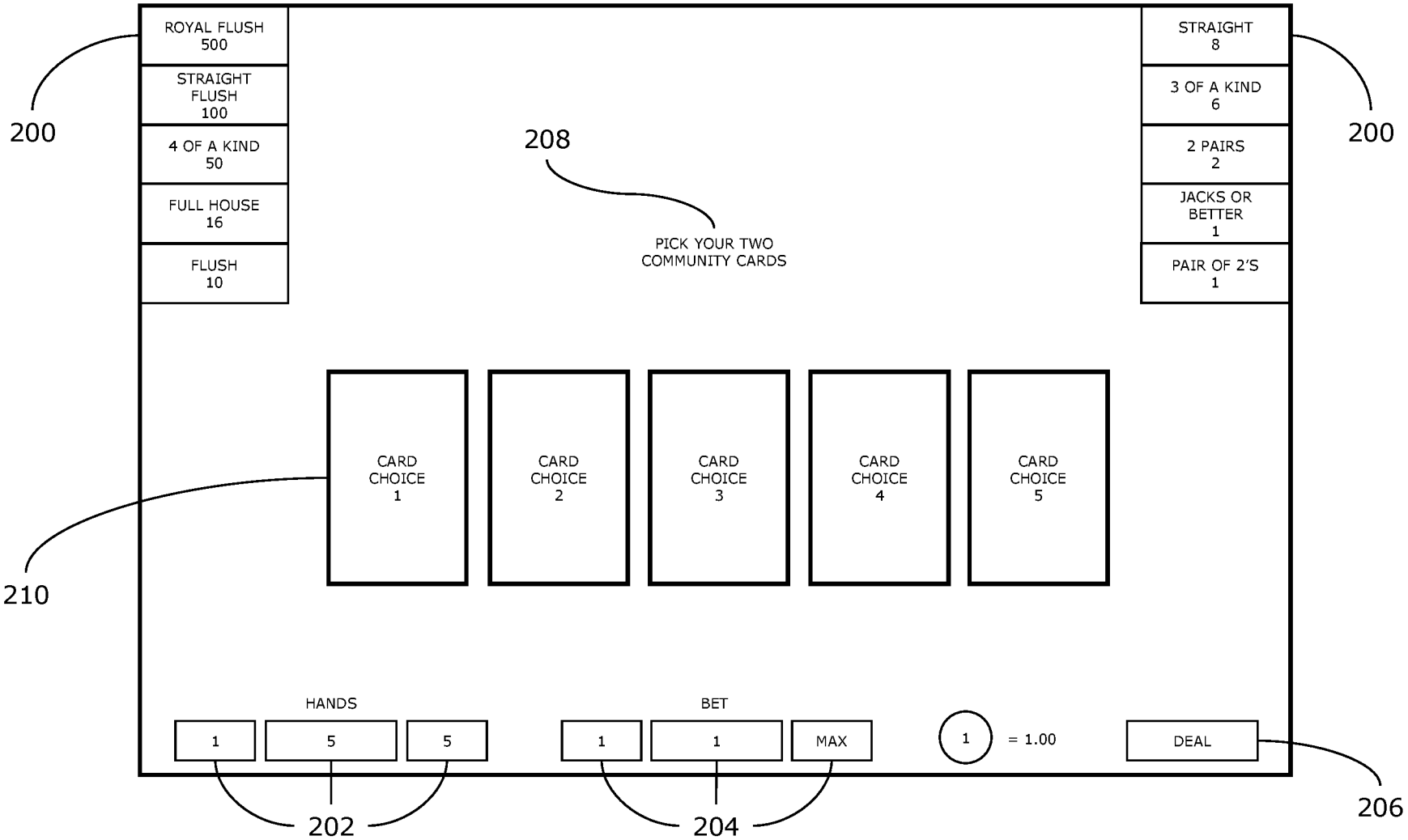
FIG. 6 is a typical initial user-interface for a game format in which the player has elected to play five hands simultaneously, bet one credit on each hand and has clicked the deal button to initiate play.

Referring now to FIG. 6, a user interface for another game format is shown. In this example, there is a second payout table 200 for achieving certain five-card poker hand combinations, a hand 210, a number-of-hand selector 202 a wager selector 204 and a deal button 206. Note that the second payout table 200 is an example and is typically based upon the number of total cards in the deck (e.g. 52 cards or 54 cards), the total cards provided to the player per hand, and the advantage desired by the game operator.

Figure 7:
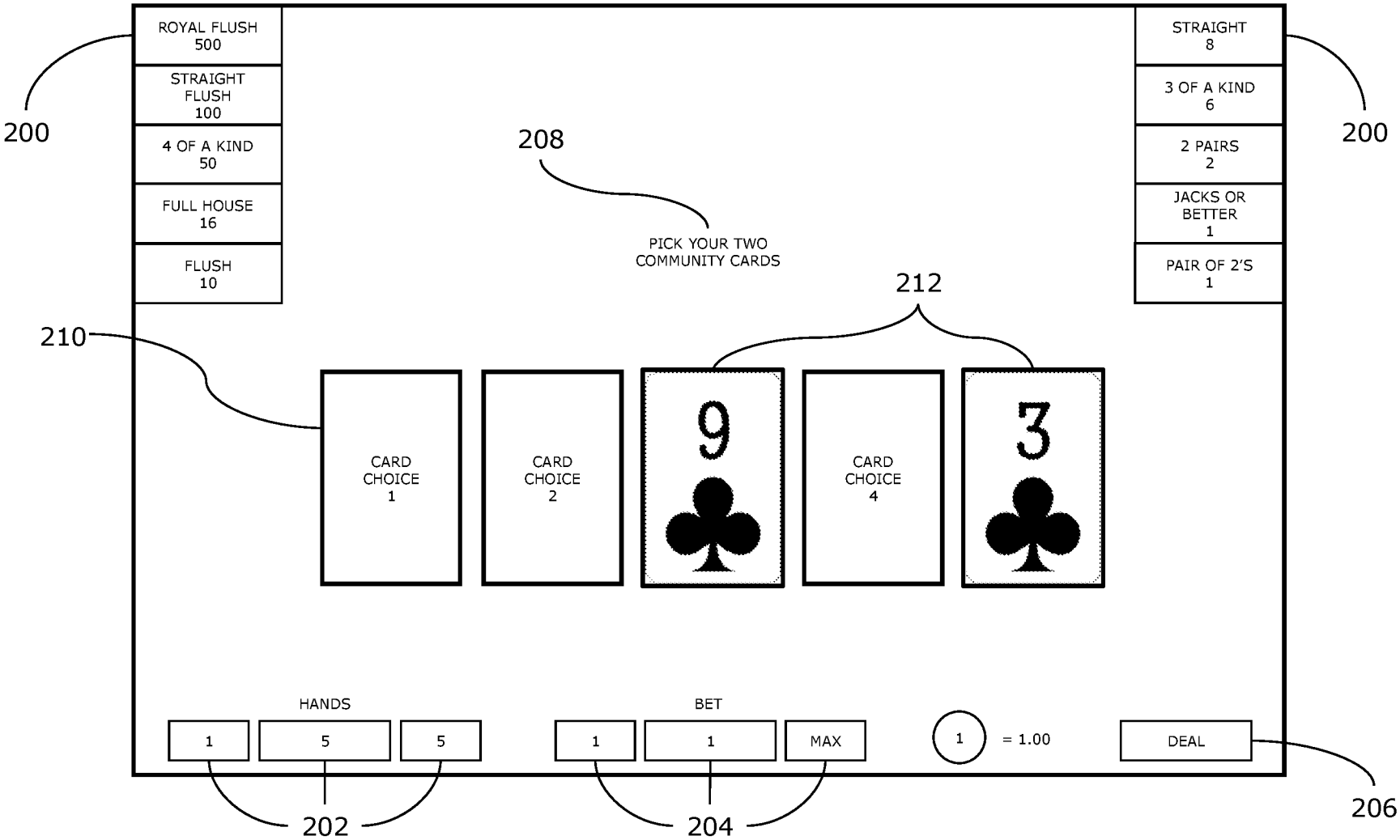
FIGS. 7 and 7B illustrates the user interface in FIG. 6 after two of the five community cards have been picked.

In the example shown in FIG. 6, the player selects to play five hands with a wager of one credit for each hand. Five cards are randomly drawn from the deck of cards 45 and presented face down in the hand 210. The player is instructed by a message 208 to pick two of the five cards of the hand 210 and the player has selected two cards to be the base community 212 as shown in FIG. 7 (the player selected the third and fifth card of the hand 210. In this example, the player finds the 9 and 3 of clubs, which will become the base community cards 212 of the player. Note that in some embodiments, the player does not have the option to select two cards and the base community cards are automatically selected for the player.

In some embodiments, or game formats, the five community cards of the hand 210 are displayed face up and the player the selects the number of cards allowed knowing what cards are available. For example, if the set of five community cards of the hand 210 that displayed face up include A-Spades, A-Diamonds, 9-Hearts, 10-Hearts, Jack-Hearts and the number of cards to select is three, the player has to decide if it is better to keep the pair of aces and one of the other cards or the three cards of the same suit in a row.

Figure 7B:
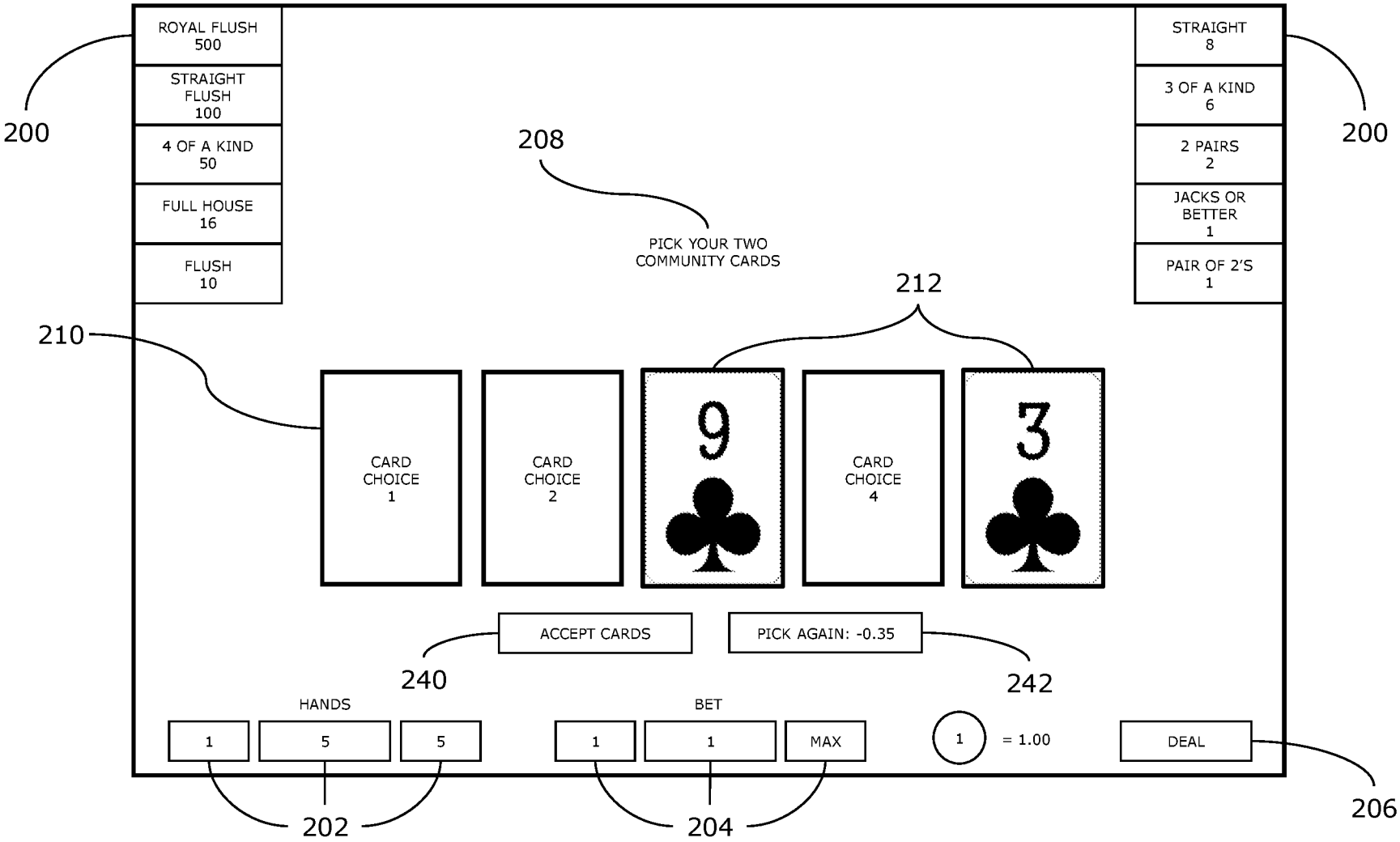
Figure 8:
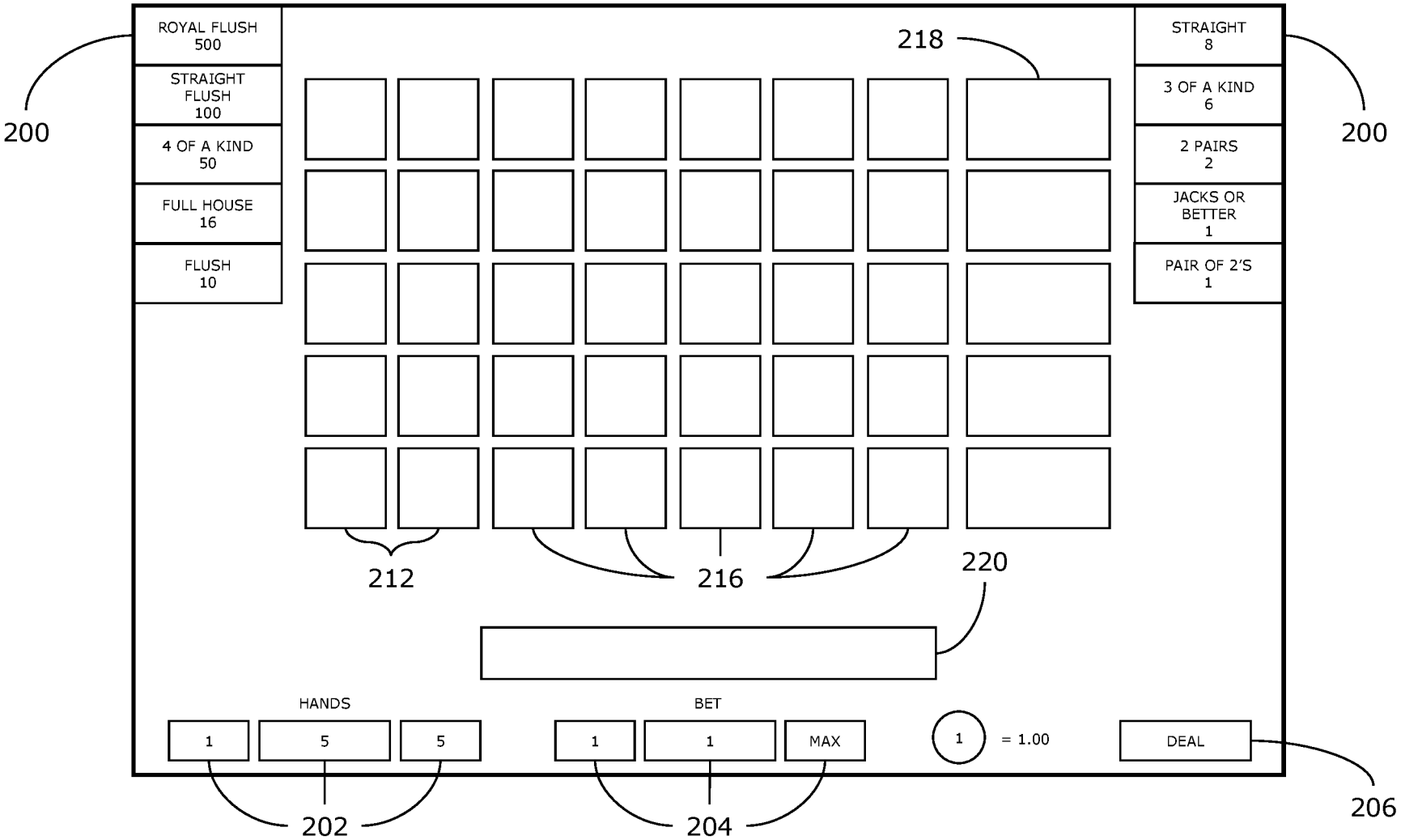
FIG. 8 illustrates the user interface in FIG. 7 after a five by five matrix has been generated to accommodate 25 hole cards that are to be randomly generated.

In some embodiments of playing, after seeing the base community cards 212, the player selects the deal button 206, play proceeds to that of FIG. 8. In some embodiments of playing as shown in FIG. 7B, after seeing the base community cards 212, the player is provided options to accept the base community cards 212 by selecting the "accept cards" option 240 or to redraw by selecting the "pick again" option 242. If the player selects the "accept cards" option 240, play resumes to that shown in FIG. 8. If the player selects the "play again" option 242, the amount of money shown (e.g. in the "pick again" option 240, which is the redraw offer, is added for each hand being played (e.g. in the example of FIG. 7B, for five hands, so −0.35×5, or −1.75 is added, or in essence, subtracted) from the player's account as shown in the credits box 110 and play reverts back to that shown in FIG. 6 with a new set of community cards of the hand 210 randomly drawn from the deck of cards 45.

In some embodiments, the redraw offer (e.g. amount collected for the "pick again" option 242) is a fixed amount that is less than the wager such as 0.50 as shown in FIG. 7B. In such, the player pays the redraw offer and gives up any chances of winning from the base community cards 212 that were selected, and in return, the player must continue with the player being required to pick two new cards as the base community cards 212. This is called a redraw, as the player pays the redraw offer or redraw amount, but continues the hand with new base community cards 212. In other words, the player pays the fixed amount in addition to the amount already bet using the wager selector 204.

In another embodiment, instead of a fixed amount for the redraw offer, the redraw offer is calculated as a cash out or surrender value of the present cards. In this embodiment, the surrender value is calculated by adding the highest payout value of the first set of cards to the sum of the probabilities of winning each payout in the second payout table 200 in view of the selected base community cards 212, then subtracting the wager. For example, a 10-Spades and J-Spades will provide a greater redraw offer than a 4-Hearts and 9-Diamonds. In such, it is anticipated that for some game combinations, the redraw offer (e.g. surrender value) will be greater than the wager or bet, as for example, if the base community cards 212 are a pair of aces, this guarantees a payout of at least 1.00 for each hand, so in such, a surrender value will be a positive amount that is higher than the wager while a 9-3 off suit may only have a surrender value of 0.70 and therefore the redraw offer will be the wager-surrender value or, negative 0.30. For the pair of aces, if the redraw offer (e.g. surrender value) is 1.75 and the wager is 1.00, the player will be credited with the difference (e.g. 0.75). In some embodiments, the redraw offer (e.g. surrender value) is neutral, providing no advantage to the operator of this game. In some embodiments, the redraw offer (e.g. surrender value) is biased, preferably to the advantage of the operator of the game. For example, the redraw offer (e.g. surrender value) is calculated as above, then multiplied by a discount value, where a discount value of 1.0 retains the neutral redraw offer (e.g. surrender value). In games that include the calculated redraw offer (e.g. surrender value) instead of a fixed redraw offer (e.g. −0.35), after surrendering the hand, play resumes to either that of FIG. 6, in which the player can walk away from the game without playing another hand or the that of FIG. 7 or where the player is already in the next hand (paying the bet) and selecting a new set of base community cards 212.

In another embodiment, the game is blackjack. The player receives two cards from the deck of cards 45 and the dealer also receives two cards from the deck of cards 45, one of which is exposed for the player to see. After seeing the player's two cards and one card of the dealer, the player is presented a redraw option (e.g. "pick again") for a certain cost (e.g. the redraw offer) and if the player is not happy with their two cards in view of the dealer's exposed card, the player accepts the redraw option and the redraw offer is deducted from the players account. In this scenario, the dealer's cards are not changed, but the player receives two new cards from the deck of cards 45. In some embodiments, the above is repeated one or more times. In some embodiments, the player's two cards are replaced into the deck of cards 45 before the player receives the two new cards, meaning that it is possible for the player to receive back one or both cards that were discarded.

Referring to FIG. 8, a transitional user interface is shown. After the community cards have been selected, a blank card matrix (e.g. face down) is generated with columns for the base community cards 212 and hole cards 216. In this example, each row is a hand. To the right of each hand is a message box 218 for that hand. Winnings are shown in the winnings box 220.

Figure 9:
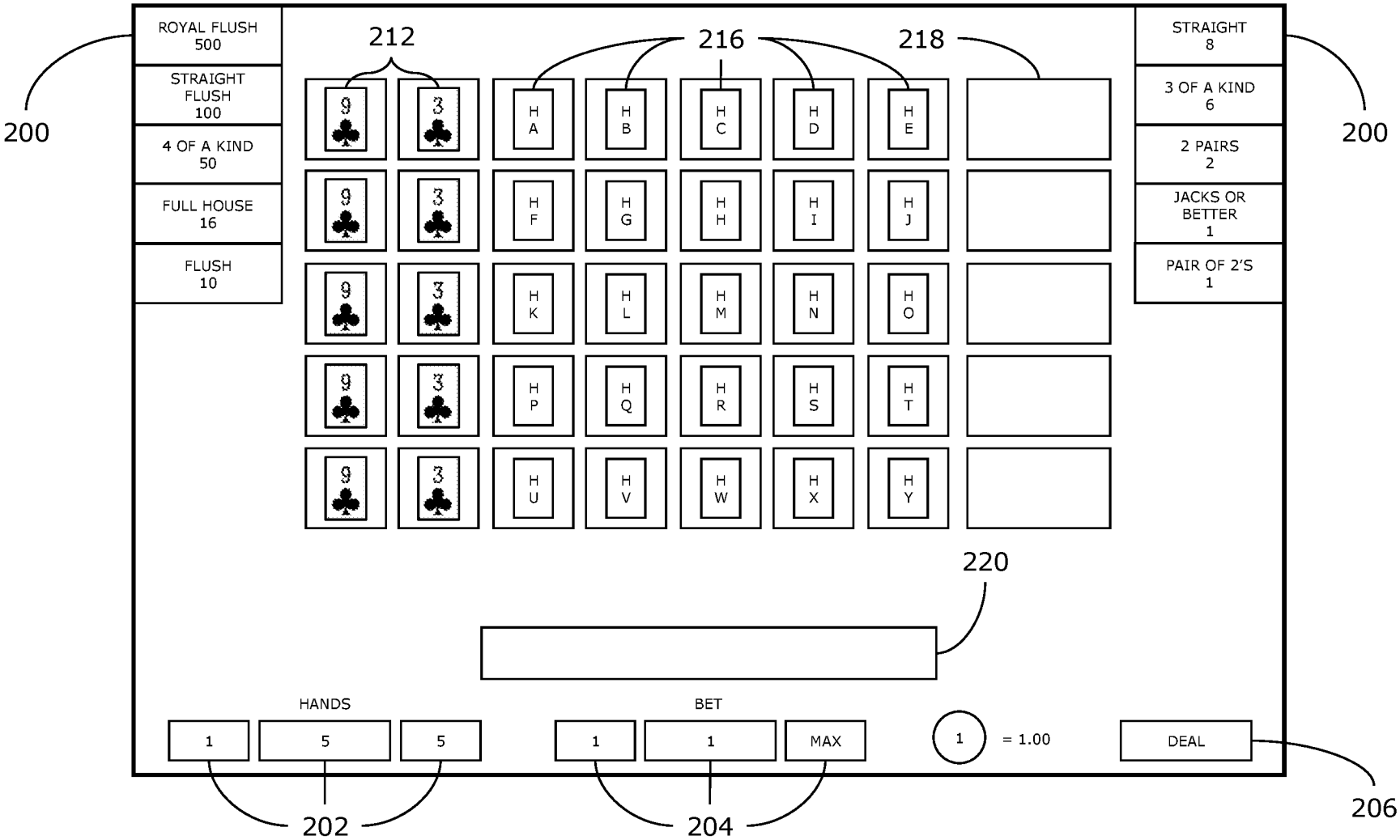
FIG. 9 illustrates the user interface in FIG. 8 the two selected community cards are placed adjacent to each row, which represents a hand and a payout line.

Referring to FIG. 9, the user-interface of FIG. 8 is shown, except the base community cards 212 are now shown (each hand receives the same base community cards 212). There are 25 hole cards 216 displayed face down so the player does not know the value for each hole card 224.

Figure 10:
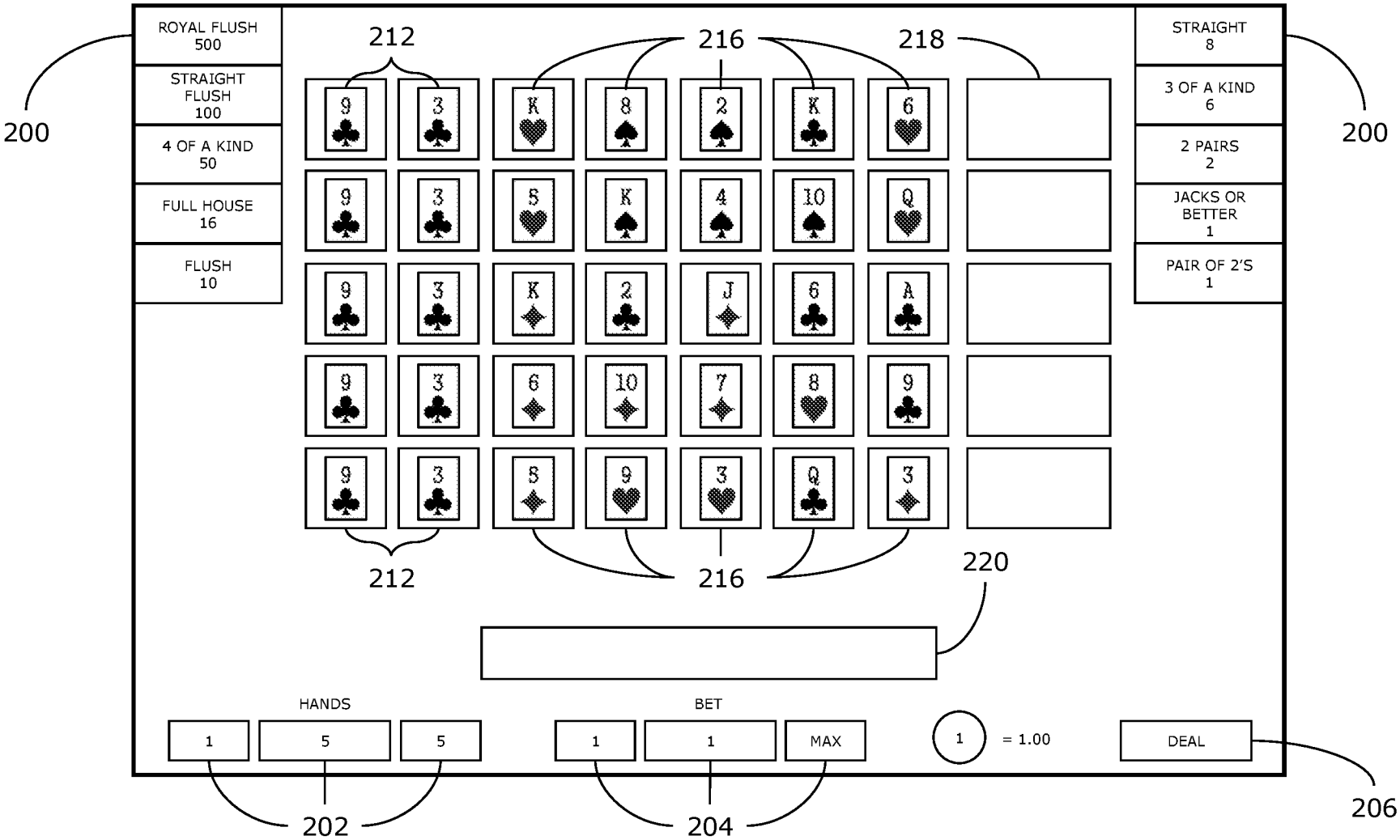
FIG. 10 illustrates the user interface in FIG. 9 after the 25 randomly generated hole cards have been placed in the slots of the five by five matrix.
Figure 11:
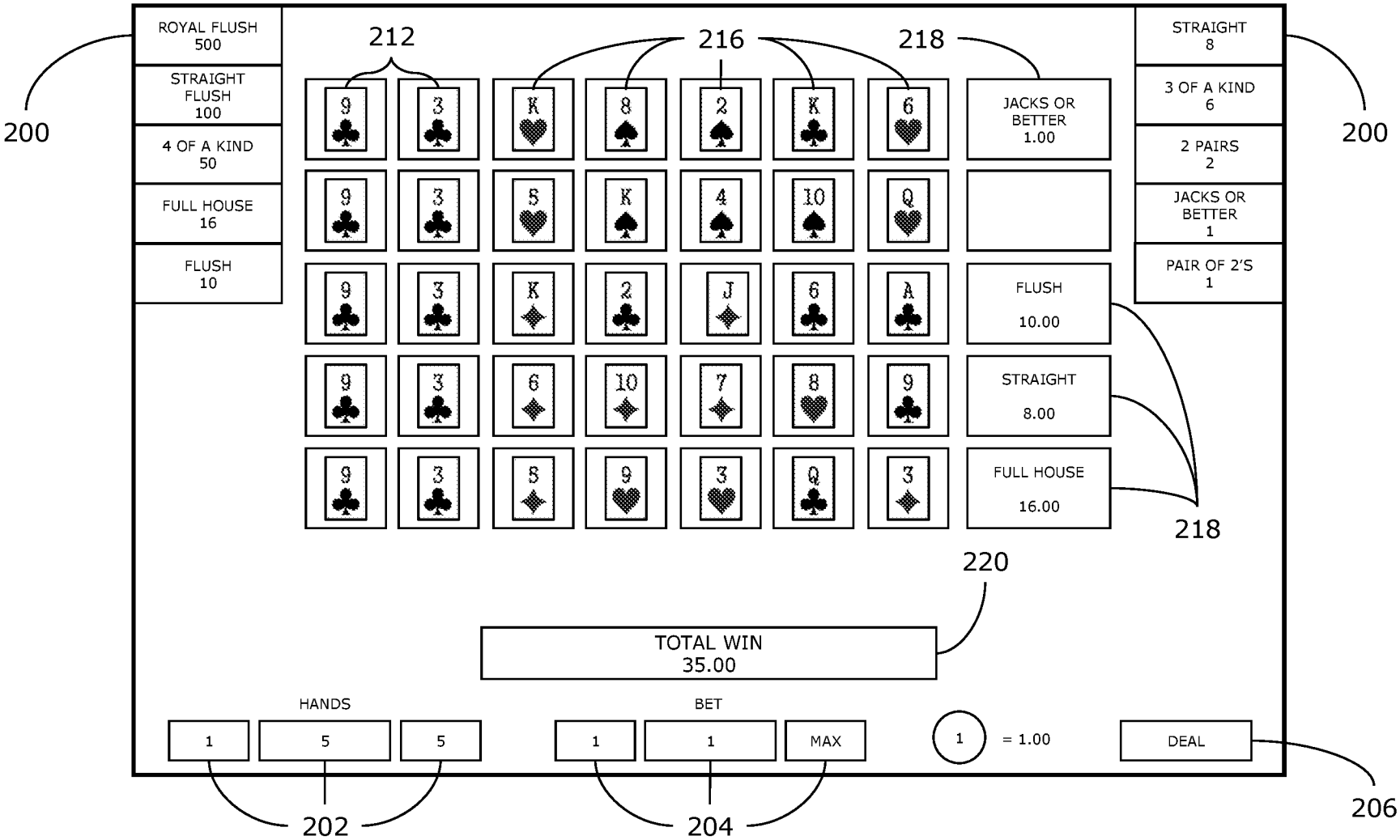
FIG. 11 illustrates the user interface in FIG. 10 after each hand of play has been analyzed to reveal that hand's highest five card combination and that hand has been credited with achieving a payout from the payout table and all winning hands have been tallied to produce a total win amount.

Referring to FIG. 10, the above described user-interface is shown with the hole cards 216 exposed (e.g. displayed face up). Now winnings are calculated based upon the best n cards in each hand including each row of base community cards 212 and hole cards 216 with respect to the second payout table 200. The winnings, if any, are then displayed in the message box 218 as shown in FIG. 11. Each hand is analyzed to determine its best n card poker combination (in some embodiments, n is five, though in some embodiments, n is six or seven for greater numbers of poker combinations). If the hand(s) is/are awarded a payout, as displayed in the message box 218 for that hand, the total win for all hands is calculated and displayed in the winnings box 220. The player can operate the deal button 206 to play the game again.

In all embodiments having a surrender value (or cash out value), the surrender value of the player's initial hand is either a fixed amount, a fixed amount plus the highest payout amount of the player's initial cards from the payout schedule, or is calculated as the sum of the probabilities of all possible winning hands times the payout for that hand plus the highest payout amount of the player's initial cards from the payout schedule. As an example, that illustrates this process, consider a simplified hand of five cards in which four cards are exposed and there is one more card left hidden from the player. For simplicity, also consider the payout schedule 100 of FIG. 4 as payouts.

In this example, the exposed cards are A-Spade, K-Spades, Q-Spades, J-Spades. Note that the highest payout amount of the player's initial cards from the payout schedule in this example is zero as there are no pairs or any other combination noted in the payout schedule. As the exposed cards are A-Spade, K-Spades, Q-Spades, J-Spades, then the following fifth cards will provide a winning hand according to the payout schedule 100: 10-Spades (royal flush) 2/3/4/5/6/7/8/9-Spades (flush), 10-Clubs (straight), 10-Diamonds (straight), 10-Hearts (straight), and the following cards will produce a hand of jacks or better: A-Clubs, A-Diamonds, A-Hearts, K-Clubs, K-Diamonds, K-Hearts, Q-Clubs, Q-Diamonds, Q-Hearts, J-Clubs, J-Diamonds, and J-Hearts. As an example, given the player has A-Spade, K-Spades, Q-Spades, J-Spades; the probability of the next card being the 10-Spades is 1 out of 52-4 or 1 out of 48, which is 0.0208. The payout for a royal flush is 500, so the probability of receiving the 10-Spades as the fifth card contributes 0.0208*500 to the sum, or approximately 10.41. The contribution to the sum by any of the other three tens would be 3*0.0208, resulting in a straight. The payout for a straight is 8, so these fifth cards contribute 3*0.0208*8, or 0.50. The contribution to the sum by any of the other spades would be 8*0.0208, resulting in a flush. The payout for a flush is 10, so these fifth cards contribute 8*0.0208*10, or 1.67. There are twelve cards that will result in a pair. The contribution to the sum by any of these cards would be 12*0.0208, resulting in a pair. The payout for a pair is 1, so these fifth cards contribute 1*0.0208*1, or 0.25. Therefore, given the player has A-Spade, K-Spades, Q-Spades, J-Spades, the sum of the above calculated surrender values is 10.41 (straight flush)+0.50 (straight)+1.67 (flush) and 0.25 (pair), plus a highest payout amount of 0.0, totaling 12.83. Therefore, in a game of 4 cards+1 card, if the player has A-Spade, K-Spades, Q-Spades, J-Spades; a neutral surrender value is 12.83 credits for a 1.00 credit bet.

For some hands, the surrender value is the same as the highest payout amount because there is no chance of improving the hand. For example, if the player has A-Spade, A-Hearts, A-Diamonds, A-Clubs, then the fifth card cannot improve the player's hand and the surrender value is the same as the highest payout amount, which is 50 per the payout schedule 100. In a similar way, even though the fifth card can improve some hands, the improved hand will not achieve a payout. Take for example 2-Clubs, 3-Clubs, 4-Diamonds, 9-Hearts. The only possible improvement is to obtain a pair of 2s, 3s, 4s, or 9s, which do not impart a payment according to the payout schedule 100 and, therefore, the surrender value is zero as there is no payment unless the player achieves at least Jacks or better.

The surrender value is calculated either by brute force or by using root combinations. Brute force requires evaluation of the hand with each possible other card to determine the payout for each, then the payout for each is multiplied by the probability of getting that card, which is 1 out of 52-4 in the example above, or 0.0208. This method requires high amounts of computational power as given each of the remaining 48 hands, the best hand out of the cards must be calculated, then that best hand used to determine the payout according to the payout schedule 100.

Instead, it is possible to use root combinations to pare down the total space and utilize tables that are generated based upon the payout table. For example, if the player has A-K-Q-J and these are not of the same suit, there is no chance of getting a flush, only 3 chances of getting a straight and 12 chances of getting a pair. Therefore, first determining if there is a secured payout (e.g. if the player has A-A-J-J, there is a secured payout of 2 for two pair according to the payout schedule 100. In as much as it makes no difference which two pairs are found, a table can be constructed that is indexed by each unique combination of initial hands that can result in a secured payout and or a payout based upon the fifth card. Therefore, by evaluating the initial hand into categories (e.g. assigning four of a kind to category-9, three of a kind to category-8, a pair to category-7, four cards in sequence to category-6, four cards in sequence except for an inside card to category-5, four cards of the same suit to category-4, three cards that are higher than a 10 to category-3, two cards that are higher than a 10 to category-2, one card that is higher than a 10 to category-1, etc., a smaller table is constructed that is indexed by the hand category. The hand is evaluated one time (e.g. A-A-A-J is evaluated to category 8 or 2-2-2-J is also evaluated to category 8), then the entry in the table for category 8 would be the secured payout for that hand which is 6.00 for three of a kind per the payout schedule 100 plus the payout for a full house times the probability of a full house (0.0208*3*16 or 1.00) plus the payout for four of a kind times the probability of four of a kind (0.0208*1*50 or 1.04). Therefore, by performing a quick evaluation of the hand comprising the first four cards to determine a category and looking up that category in a table, it is quickly determined that the surrender value of that hand (e.g. A-A-A-J) is 6.00+1.00+1.04, or 8.04, assuming that the operator of the game remains neutral on whether the hand is surrendered or not. If the operator of the game desires extra income from those who surrender, then the surrender value is discounted by the added margin desired. For example, if the operator desires an extra 1% advantage when a player surrenders their hand, the calculated or looked-up surrender value is discounted by that advantage, so if the surrender value for A-A-A-J is 8.04, if the game operator desires an additional 1% advantage, the surrender value provided to the player for this hand will be 8.04*(1−0.01) or 7.96.

Note that the above examples have been explained in view of one of the simplest poker games of five cards, four initial cards and one final card that is revealed after either surrendering or continuing play without surrendering. The math of probabilities as well as number of permutations and table sizes increases greatly with the number of cards and with the number of unknown cards at the time of deciding on surrendering. For example, given a five-card game in which the player sees three cards and must decide whether to surrender before seeing the next two cards, there are many more combinations of possible outcomes based upon three cards then one card as above. Likewise, the number of permutations increases greatly as the total number of cards increases such as in the game described in FIG. 3 through FIG. 5 having a total of seven cards per hand.

It is fully anticipated that the game operator provides the surrender value without an additional advantage being that the game operator is already benefiting by the advantage provided by the payout table. For example, if one sums the probabilities of obtaining each hand in the payout table by the payout for that hand, the total comes to less than one, usually somewhere between 0.93 and 0.96 meaning that, on average, for each hand played, the game operator pays back 0.93 to 0.96 for each 1.00 bet.

The above described games are shown utilizing an electronic representation of a single deck of playing cards. Electronic representation of decks of playing cards are known in the industry, including the standard 52 card, four suit deck as often used to play poker, a 52 card deck plus one or two jokers, a 24 card deck as used in Euchre, a deck of cards as used in Uno®, a deck representing tarot cards, or any deck of cards in which different hands (subsets of the cards) result, all of which are anticipated and included herein. Further, the above games are described having a single deck of n card, though it is fully anticipated that multiple decks be employed, for example, one deck for each hand.

Additionally, the above described games are based upon poker hands, though there is no limitation to only poker or to standard payout tables. For example, it is anticipated to apply the above disclosed technology to any type of game. One example is "Scrabble® where the player is provided some number of letter tiles (electronically selected randomly and displayed) and the player will receive another number of letter tiles after a surrender offer is made and the player makes a decision as to whether to surrender or not, the payouts and surrender value made based upon the best scoring word that can be made from the full set of letter tiles.

Figure 12:
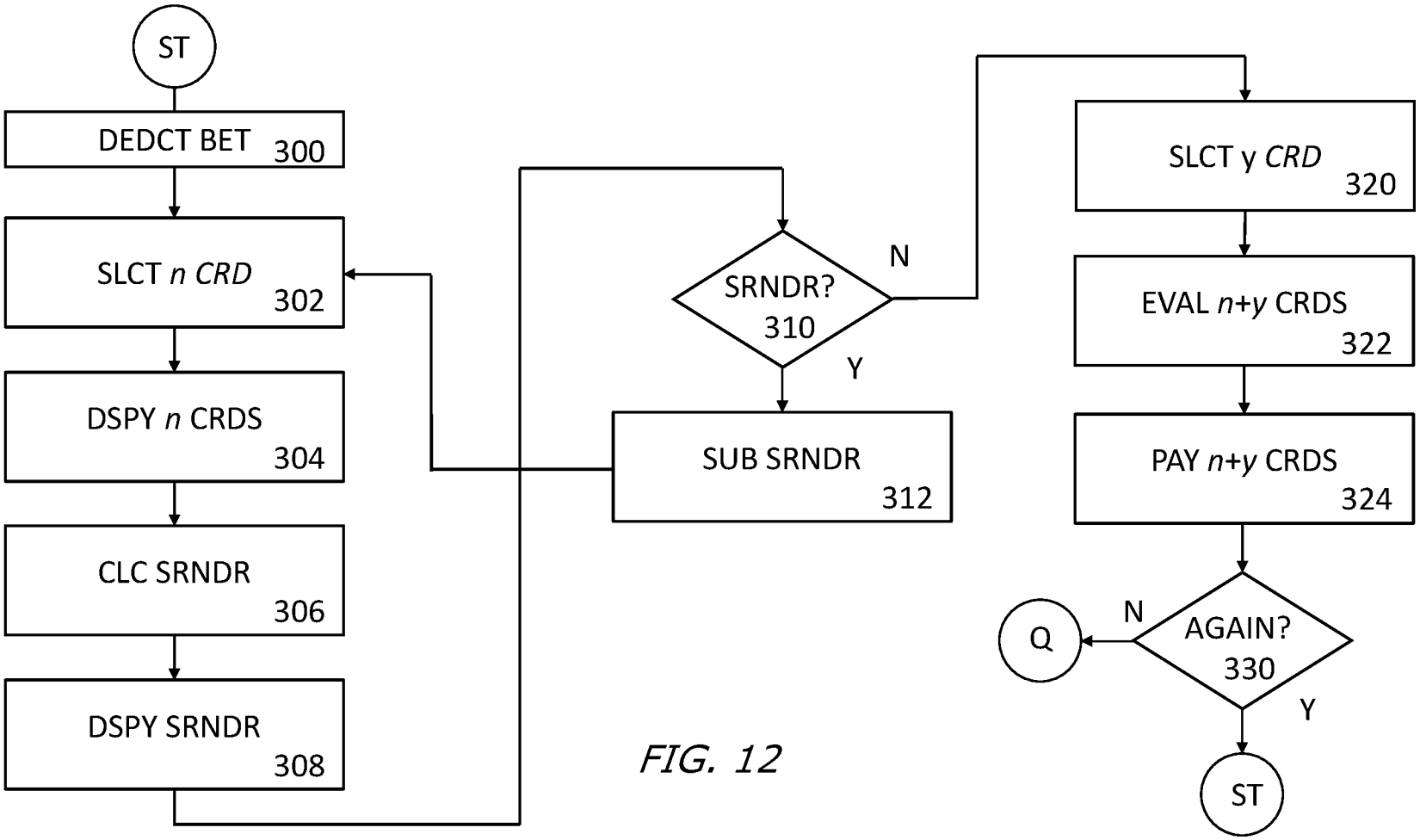
FIG. 12 illustrates a sample program flow.

Referring now to FIG. 12, a sample program flow of the above games is shown. The sample program flow is shown for playing a single hand at a time, though any number of hands played simultaneous are anticipated. Flow starts with deducting the bet 300 from the player's account. For example, subtracting one unit (e.g. one dollar, one point, one Euro) from the amount of credit that the player currently has in their account. Next n cards are randomly selected 302 from the deck and displayed 304 to the player. A surrender value is calculated 306 as described above and the surrender value is displayed 308 to the player. If the player accepts the surrender 310, the surrender value is deducted from the player's account and play continues with selecting new cards 302-310. In some embodiments, the player is presented with only one opportunity to surrender.

If the player does not accept the surrender 310, the next set of y cards are randomly selected 320 from the deck and the hand consisting of the first set of n cards and the second set of y cards is evaluated 322 for the best possible winning combinations and the payment 324 based upon the best possible winning combination is paid by adding the payment 324 to the player's account. Next, the player decides to play again 330, restarting the above, or, if not, quitting.

The above noted cash out and/or redraw functions are equally applicable to other games such as other card games like Pai Gow, three-card poker, Black Jack, etc., in which the player opposes the house (has to beat a hand or hands that the dealer has). In such, the player receives a number of cards, as does the dealer, and the player makes decisions with those cards and/or receives subsequent cards. In any case, it is anticipated that after receiving the initial set of cards and, in some embodiments such as Black Jack, seeing part of the dealer's hand, the player will be presented with either a cash-out offer or a re-draw offer. For example, in Pai Gow, after the player receives seven cards, the player must arrange the cards into a two-card hand and a 5-card hand before the dealer shows any cards. After receiving the seven cards, the game is able to calculate the probability of beating both the dealer's two-card hand and the dealer's five-card hand and the probability of a tie (only beating one of the dealer's hands) and, use that probability to offer a cash-out offer (e.g. 0.88 for a 1.00 bet if the player's hand is very good or 0.05 if the player's hand is not very good). In a similar way, the player is offered a re-draw for a fee, say $0.50. If the player accepts the re-draw fee, the player gets seven new cards. In Black Jack, the player and dealer each get two cards then the player decides whether to stay, split, take a hit, double down, etc. In some embodiments, when the player receives the initial two cards, the player is presented with a re-draw offer and if accepted, the player pays the requested amount and gets two new cards (the dealer's cards remain the same). In another embodiment, at each stage in which the player has a possible decision, the game is able to calculate the probability of beating the dealer's two-card hand (e.g. the card that is showing and any other random card remaining in the deck) and, use that probability to offer a cash-out offer (e.g. 0.88 for a 1.00 bet if the player's two cards are good and the dealer's exposed card is bad or 0.05 if the player's two cards are not very good and/or the dealer's exposed card is strong). In such, if the player does not accept the cash-out offer (for example, the player has two aces and the dealer has an 8), the player has the option to take additional cards, to double down, to split into two hands (additional ante may apply), etc. After the player takes any of these actions, it is anticipated (optionally) that another cash-out offer be made, etc., until the player either busts (hand totals over 21) or the player stands, at which the dealer's second card is exposed and it is determined whether the dealer wins, player wins, or a draw.

Although described with respect to card games, the redraw offer and/or cash-out offer is anticipated for any other type of game played either individually or against the dealer. For example, games including tiles or dice such as Yahtzee®, Bingo, Keno, Scrabble®, etc. As an example, in Keno®, the player decides a number of picks he/she will make from one through 20, then picks that many numbers from the range of numbers in the game. For example, in a game having a range of numbers from 1-75 and the player picks five numbers: 7, 11, 15, 22, and 30. The game system then randomly selects, typically, twenty numbers in the range of numbers and if the game selects the numbers selected by the player (or in some games, a subset of the numbers selected by the player), the player wins a prize based upon the number of correct numbers. In a cash-out version of Keno, it is anticipated that after a certain quantity of numbers have been selected by the game (e.g. after 10 numbers are selected), the probabilities of a each payout to the player is calculated and the player is offered a cash-out amount proportional to the predicted payout and, if accepted, receives the cash-out amount and if not selected, the next ten numbers are selected to see if the player wins based upon the standard win calculations. Likewise, in craps, the player makes a bet and rolls the dice. If the player doesn't roll a certain combination of the dice (craps or natural), the player has a point to meet in successive rolls of the dice. In such, the game calculates the probability of the player winning based upon the point and presents a cash-out offer.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. An improved gaming system comprising:

a game server;

a client device, the client device for use by a player;

a software representation of a deck of cards;

a payout schedule accessible by the game server, the payout schedule includes a payout amount for achieving each of certain combinations of cards;

the game server displays a user interface that requests a wager on the client device;

after agreement to the wager is entered in the user interface, the client device sends a transaction to the game server indicating the agreement and the game server debits the wager from an account associated with the client device;

after the game server debits the wager, the game server randomly selects and moves a first number of cards from the deck of cards into a first set of cards;

the game server sends the first set of cards to the client device and the client device displays the first set of cards in the user interface;

the game server analyzes the first set of cards in real time to determine a combination of the first set of cards that yield a highest payout amount from the payout schedule;

the game server calculates a present value of the first set of cards, in real time, by setting the present value of the first set of cards to the highest payout amount and then for each possible combination of a second number of cards taken from cards remaining in the deck of cards: adding to the present value of the first set of cards, a product of a probability of achieving the second number of cards and a payout amount for achieving the first set of cards combined with the second number of cards from the payout schedule;

the game server then sets the present value of the first set of cards to a product of the present value of the first set of cards and a discount value;

the game server sends the present value of the first set of cards to the client device and the client device displays the present value of the first set of cards in the user interface along with an accept directive and a reject directive;

upon activation of the accept directive, the client device sends an acceptance transaction to the game server and when the game server receives the acceptance transaction from the client device, the game server credits the account associated with the client device with the present value of the first set of cards; and upon activation of the reject directive, the client device sends a rejection transaction to the game server and when the game server receives the rejection transaction from the client device, the game server randomly selects the second number of cards to be a second set of cards from the cards remaining in the deck of cards and the game server analyzes the first set of cards combined with the second set of cards to determine the combination of the first set of cards with the second set of cards that yields the highest payout amount from the payout schedule, then the game server credits the account associated with the client device with the highest payout amount; and the game server sends the second set of cards, the combination of the first set of cards with the second set of cards that yield the highest payout amount, and the highest payout amount to the client device; and the client device displays the second set of cards, the combination of the first set of cards with the second set of cards that yield the highest payout amount and the highest payout amount in the user interface.

2. The improved gaming system of claim 1, wherein the software representation of the deck of cards comprises 52 poker-style cards.

3. The improved gaming system of claim 2, wherein the software representation of the deck of cards further comprises one or two wild cards of joker-style cards.

4. The improved gaming system of claim 1, wherein the first number is five and the second number is two.

5. The improved gaming system of claim 1, wherein the first number is two and the second number is five.

6. The improved gaming system of claim 1, wherein the first set of cards is divided into a subset of a third number of community cards and a subset of a fourth number of hole cards.

7. The improved gaming system of claim 1, wherein the discount value is 1.0.

8. An improved method of gaming by a player, the method comprising:

requesting a wager;

debiting the wager from an account;

randomly selecting a first number of cards from a software representation of a deck of cards and moving the first number of cards into a first set of cards;

displaying the first set of cards on a display for viewing by the player;

analyzing the first set of cards and determining a combination of the first set of cards that yields a highest payout amount from a payout schedule, the payout schedule including a payout amount for achieving each of certain combinations of the cards;

calculating, in real time, a present value of the first set of cards by setting the present value of the first set of cards to the highest payout amount, then, for each combination of the first set of cards and a second number of cards from cards that remain in the deck of cards: adding to the present value of the first set of cards a probability of achieving the each combination of the first set of cards and the second number of cards multiplied by a payout amount for the each combination of the first set of cards and the second number of cards from the payout schedule;

displaying the present value of the first set of cards and an option to accept or reject the present value of the first set of cards on the display;

when receiving acceptance, crediting the account with the present value of the first set of cards;

when receiving rejection, randomly selecting the second number of cards to be a second set of cards from the cards remaining in the deck of cards and analyzing the first set of cards combined with the second set of cards, determining the combination of the first set of cards with the second set of cards that yields the highest payout amount from the payout schedule; and crediting the account with the highest payout amount; displaying the second set of cards, the combination of the first set of cards with the second set of cards that yield the highest payout amount, and displaying the highest payout amount on the display for viewing by the player.

9. The method of claim 8, wherein the software representation of the deck of cards comprises 52 poker-style cards.

10. The method of claim 9, wherein the software representation of the deck of cards further comprises one or two wild cards of joker-style cards.

11. The method of claim 8, wherein the first number is five and the second number is two.

12. The method of claim 8, wherein the first number is two and the second number is five.

13. The method of claim 8, wherein the first set of cards is divided into a subset of a third number of community cards and a subset of a fourth number of hole cards.

14. The method of claim 13, wherein the third number is three and the fourth number is two.

15. A non-transitory storage medium having program instructions stored therein, the program instructions comprising at least one instruction configured to implement an improved system for gaming by a player, wherein the at least one instruction comprises:

computer readable instructions executed by a processor causing the improved system for gaming to display a user interface on a display, the user interface requests a wager;

the computer readable instructions executed by the processor further causing the improved system for gaming to debit the wager from an account;

the computer readable instructions executed by the processor further causing the improved system for gaming to randomly select a first number of cards from a software representation of a deck of cards and to move the first number of cards into a first set of cards;

the computer readable instructions executed by the processor further causing the improved system for gaming to display the first set of cards on the display for viewing by the player;

the computer readable instructions executed by the processor further causing the improved system for gaming to analyze the first set of cards and to determine a combination of the first set of cards that yields a highest payout amount from a payout schedule, the payout schedule including a payout amount for achieving each of certain combinations of the cards;

the computer readable instructions executed by the processor further causing the improved system for gaming to calculate a present value of the first set of cards and all possible combinations of a second number of cards taken from the cards remaining in the deck by setting the present value of the first set of cards to the highest payout amount, then, for each combination of the first set of cards and the second number of cards, adding to the present value of the first set of cards a probability of achieving the second number of cards multiplied by the highest payout amount for achieving the first set of cards and the second number of cards from the payout schedule;

the computer readable instructions executed by the processor further causing the improved system for gaming to display the present value of the first set of cards and an option to accept or reject the present value of the first set of cards on the display for viewing by the player;

when receiving an acceptance, the computer readable instructions executed by the processor further causing the improved system for gaming to credit the account with the present value of the first set of cards;

when receiving a rejection, the computer readable instructions executed by the processor further causing the improved system for gaming to randomly select the second number of cards to be a second set of cards from the cards remaining in the deck of cards and to analyze the first set of cards combined with the second set of cards to determine the combination of the first set of cards with the second set of cards that yields the highest payout amount from the payout schedule and to credit the account with the highest payout amount; and the computer readable instructions executed by the processor further causing the improved system for gaming to credit the account with the highest payout amount; to display on the display the second set of cards, the combination of the first set of cards with the second set of cards that yield the highest payout amount, and the highest payout amount for viewing by the player.

16. The non-transitory storage medium having program instructions stored therein of claim 15, the program instructions comprising the at least one instruction configured to implement the improved system for gaming by the player, wherein the software representation of the deck of cards comprises 52 poker-style cards.

17. The non-transitory storage medium having program instructions stored therein of claim 15, the program instructions comprising the at least one instruction configured to implement the improved system for gaming by the player of claim 16, wherein the software representation of the deck of cards further comprises one or two wild cards of joker-style cards.

18. The non-transitory storage medium having program instructions stored therein of claim 15, the program instructions comprising the at least one instruction configured to implement the improved system for gaming by the player of claim 15, wherein the first number is five and the second number is two.

19. The non-transitory storage medium having program instructions stored therein of claim 15, the program instructions comprising the at least one instruction configured to implement the improved system for gaming by the player of claim 15, wherein the first number is two and the second number is five.

20. The non-transitory storage medium having program instructions stored therein of claim 15, the program instructions tangibly comprising the at least one instruction configured to implement the improved system for gaming by the player of claim 15, wherein the first set of cards is divided into a subset of a third number of community cards and a subset of a fourth number of hole cards.

* * * * *